US008968010B2

(12) United States Patent
Endo et al.

(10) Patent No.: US 8,968,010 B2
(45) Date of Patent: Mar. 3, 2015

(54) PRESS-FIT TYPE CONNECTOR TERMINAL

(71) Applicant: Dai-Ichi Seiko Co., Ltd., Kyoto (JP)

(72) Inventors: Takayoshi Endo, Shizuoka (JP); Takuya Takeda, Shizuoka (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 79 days.

(21) Appl. No.: 13/795,574

(22) Filed: Mar. 12, 2013

(65) Prior Publication Data

US 2013/0244506 A1 Sep. 19, 2013

(30) Foreign Application Priority Data

Mar. 16, 2012 (JP) ..... 2012-61040

(51) Int. Cl.

| | |
|---|---|
| ***H01R 12/00*** | (2006.01) |
| ***H01R 4/48*** | (2006.01) |
| ***H01R 12/58*** | (2011.01) |
| ***H01R 13/05*** | (2006.01) |

(52) U.S. Cl.

CPC ..... *H01R 4/48* (2013.01); *H01R 12/585* (2013.01); *H01R 13/055* (2013.01); *Y10S 439/947* (2013.01)

USPC ..... 439/82; 439/947

(58) Field of Classification Search

USPC ..... 439/82, 751, 947

See application file for complete search history.

(56) References Cited

U.S. PATENT DOCUMENTS

| | | | | |
|---|---|---|---|---|
| 3,031,641 | A | 4/1962 | Camzi | |
| 3,634,819 | A * | 1/1972 | Evans | 439/825 |
| 4,017,143 | A * | 4/1977 | Knowles | 439/873 |
| 4,191,440 | A * | 3/1980 | Schramm | 439/751 |
| 4,219,251 | A * | 8/1980 | Romine | 439/692 |
| 4,343,530 | A * | 8/1982 | Leger | 439/870 |
| 4,353,609 | A * | 10/1982 | Haas | 439/82 |
| 4,384,757 | A * | 5/1983 | Andrews et al. | 439/736 |
| 4,721,471 | A * | 1/1988 | Mueller | 439/78 |
| 4,752,250 | A * | 6/1988 | Seidler | 439/751 |
| 4,790,764 | A * | 12/1988 | Kawaguchi et al. | 439/78 |
| 4,818,237 | A * | 4/1989 | Weber | 439/693 |
| 4,824,380 | A * | 4/1989 | Matthews | 439/78 |
| 4,826,456 | A * | 5/1989 | Kraus et al. | 439/751 |
| 5,145,408 | A * | 9/1992 | Houtteman et al. | 439/581 |
| 5,147,228 | A * | 9/1992 | Miller et al. | 439/741 |

(Continued)

FOREIGN PATENT DOCUMENTS

| | | |
|---|---|---|
| DE | 20 2009 006 254 | 7/2009 |
| JP | 63-26985 | 2/1988 |

(Continued)

OTHER PUBLICATIONS

European Search Report issued May 29, 2013 in corresponding European Patent Application No. EP 13 15 5676.

*Primary Examiner* — Neil Abrams

(74) *Attorney, Agent, or Firm* — Wenderoth, Lind & Ponack, L.L.P.

(57) ABSTRACT

The press-fit type connector terminal includes a pin section in the form of a flat plate, and a plurality of contact sections situated continuous to a front end of the pin section. Each of the contact sections includes a contact piece in the form of a barrel or a spindle surrounding an imaginary center line, the contact piece being formed with a slit extending substantially parallel to the imaginary center line, and the connector terminal is comprised of a single bent metal plate having elasticity.

15 Claims, 35 Drawing Sheets

(56) References Cited

U.S. PATENT DOCUMENTS

| | | | | |
|---|---|---|---|---|
| 5,582,519 | A * | 12/1996 | Buchter | 439/101 |
| 5,630,720 | A * | 5/1997 | Kocher | 439/78 |
| 5,842,876 | A * | 12/1998 | Collin et al. | 439/78 |
| 6,062,916 | A * | 5/2000 | Gladd et al. | 439/751 |
| 6,210,240 | B1 * | 4/2001 | Comerci et al. | 439/853 |
| 6,299,492 | B1 * | 10/2001 | Pierini et al. | 439/884 |
| 6,338,632 | B1 * | 1/2002 | Jones | 439/82 |
| 6,402,525 | B2 * | 6/2002 | Gugliotti et al. | 439/65 |
| 6,461,174 | B1 * | 10/2002 | Hwang | 439/80 |
| 6,488,549 | B1 * | 12/2002 | Weller et al. | 439/856 |
| 6,702,595 | B2 * | 3/2004 | Nelson et al. | 439/83 |
| 6,923,661 | B1 * | 8/2005 | Bogiel et al. | 439/78 |
| 6,974,329 | B2 * | 12/2005 | Henneberg | 439/59 |
| 7,104,812 | B1 * | 9/2006 | Bogiel et al. | 439/79 |
| 7,273,398 | B2 * | 9/2007 | Taylor et al. | 439/620.2 |
| 7,500,857 | B2 * | 3/2009 | Schmid et al. | 439/78 |
| 7,604,489 | B2 * | 10/2009 | Shuey et al. | 439/79 |
| 7,806,738 | B2 * | 10/2010 | Wu et al. | 439/860 |
| 7,905,731 | B2 * | 3/2011 | Ngo et al. | 439/75 |
| 7,957,156 | B2 * | 6/2011 | Palomo | 361/779 |
| 8,057,266 | B1 * | 11/2011 | Roitberg | 439/682 |
| 8,277,265 | B1 * | 10/2012 | Sykes et al. | 439/862 |
| 8,888,541 | B2 * | 11/2014 | Endo et al. | 439/751 |
| 2003/0124886 | A1 * | 7/2003 | Reisdorf et al. | 439/82 |
| 2006/0128197 | A1 * | 6/2006 | McGowan et al. | 439/212 |
| 2009/0209143 | A1 | 8/2009 | Wu et al. | |
| 2010/0279523 | A1 | 11/2010 | Schwettmann et al. | |

FOREIGN PATENT DOCUMENTS

| | | |
|---|---|---|
| JP | 2004-134275 | 4/2004 |
| JP | 2005-135698 | 5/2005 |
| JP | 2007-157469 | 6/2007 |
| JP | 2009-21016 | 1/2009 |

* cited by examiner

PRESS-FIT TYPE CONNECTOR TERMINAL

BACKGROUND OF THE INVENTION

1. Field of the Invention

The invention relates to a press-fit type connector terminal to be inserted into an electrically conductive through-hole formed through a printed circuit board.

2. Description of the Related Art

Various press-fit type connector terminals have been suggested. For instance, there is a terminal contact section having a needle-eye, C-shaped, N-shaped or Σ-shaped cross-section.

Japanese Patent Application Publication No. 2004-134275 has suggested a press-fit type connection terminal including a head to which a cable is connected, and a body to be inserted into a through-hole formed through a substrate. The body is centrally formed with a hole extending in a length-wise direction thereof, and the body is formed with a plurality of slits extending from an inner wall to an outer wall of the body. The hole is filled with electrically conductive adhesive.

Japanese Patent Application Publication No. 2007-157469 has suggested a press-fit type terminal including a press-fit section, a terminal base, and a male terminal. The press-fit section includes a contact having a shape which is readily able to make contact with a through-hole, and a compression section composed of elastic material. The compression section is inserted into an opening of the contact, and the compression section exerts an elastic force on the contact such that the contact is compressed into the through-hole.

Since a maximum current which can run through the above-mentioned press-fit type connector terminal is dependent on a size of the press-fit type connector terminals, it is necessary to enlarge a size of them in order to make it possible to cause a higher amount of current to run therethrough. However, a through-hole of a printed circuit board into which a contact section of a press-fit type connector terminal is inserted has an upper limit in an inner diameter thereof in dependence on a thickness of the printed circuit board. If a through-hole were designed to have an inner diameter over the upper limit, contact defectiveness between the through-hole and a press-fit type connector terminal tends to occur, resulting in reduction in contact reliability.

Thus, for instance, Japanese Patent Application Publication No. 2005-135698 has suggested a press-fit type connector terminal including a wide terminal branched at a distal end thereof into a plurality of sub-terminals to be inserted into through-holes, in order to allow a large amount of current to run therethrough.

The conventional press-fit type connector terminals suggested in the above-mentioned Publications Nos. 2004-134275 and 2007-157469 are difficult to allow a large amount of current to run therethrough. Furthermore, since they are designed to have an outer diameter greater than an inner diameter of a through-hole of a printed circuit board, and make electrical contact with a through-hole by inserting the press-fit section having low elasticity into a through-hole, there are caused problems that a printed circuit board is whitened due to a contact pressure exerted by the press-fit section onto a through-hole, and a metal plated on an inner surface of a through-hole is peeled off. Since whitening of a printed circuit board means molecular destruction of components of which the board is composed, the molecular destruction induces not only degradation in electrical insulation of a printed circuit board and deterioration in a withstand voltage, but also an increase in a resistance of a circuit pattern.

The press-fit type connector terminal suggested in the above-mentioned Publication No. 2005-135698 is able to allow a large amount of current to run therethrough, because it has a wide terminal branched at a distal end thereof into a plurality of sub-terminals to be inserted into through-holes. However, since each of the sub-terminals to be inserted into a through-hole of a printed circuit board is needle-eye shaped, the press-fit type connector terminal cannot absorb a dimensional tolerance caused between a through-hole and each of the sub-terminals, resulting in degradation in contact reliability.

SUMMARY OF THE INVENTION

In view of the above-mentioned problems in the conventional press-fit type connector terminals, it is an object of the present invention to provide a press-fit type connector terminal which is capable of allowing a large amount of current to run therethrough without an increase in a diameter of a through-hole of a printed circuit board, reducing a force by which the press-fit type connector terminal is inserted into a through-hole, preventing a contact section from being plastically deformed, preventing a printed circuit board from being whitened, and presenting superior contact reliability.

In the first aspect of the present invention, there is provided a press-fit type connector terminal including a pin section in the form of a flat plate, and a plurality of contact sections situated continuous to a front end of the pin section. Each of the contact sections include a contact piece in the form of a barrel or a spindle surrounding an imaginary center line, the contact piece being formed with a slit extending substantially parallel to the imaginary center line, and the connector terminal is comprised of a single bent metal plate having elasticity.

In the press-fit type connector terminal in accordance with the present invention, since a plurality of the contact sections continuous to a front end of the pin section being in the form of a flat plate are arranged in series, it is possible to allow a large amount of run to through the press-fit type connector terminal without an increase in a diameter of a through-hole of a printed circuit board.

Furthermore, since each of the contact sections is in the form of a barrel or a spindle being able to elastically enlarge or reduce a diameter thereof, the contact piece defining the contact section can be elastically deformed to be inserted into a through-hole when each of the contact sections is inserted into a through-hole of a printed circuit board. Hence, each of the contact sections no longer exerts an excessive compression force (contact pressure) onto an inner surface of a through-hole. Accordingly, it is possible to reduce a force with which the press-fit type connector terminal is inserted into a through-hole formed through a printed circuit board, prevent the contact sections from being plastically deformed when the press-fit type connector terminal is inserted into a through-hole, prevent a printed circuit board from being whitened, and further prevent a plated surface of a through-hole from being degraded. Furthermore, since the contact piece inserted into a through-hole makes contact with an inner surface of the through-hole, keeping a force with which the contact piece enlarges a diameter thereof, by virtue of elasticity thereof, it is possible to prevent occurrence of contact defectiveness, and provide superior contact reliability.

In addition, since the press-fit type connector terminal in accordance with the present invention can be formed by bending a single metal plate having elasticity, it is possible to reduce a number of parts and reduce fabrication costs.

In the second aspect of the present invention, there is provided a press-fit type connector terminal including a pin section in the form of a flat plate, and a plurality of contact sections situated continuous to a front end of the pin section. Each of the contact sections include a plurality of "<"-shaped or arcuate contact pieces extending around an imaginary center line and outwardly protruding so as to surround the imaginary center line, and the connector terminal is comprised of a single bent metal plate having elasticity.

In the press-fit type connector terminal in accordance with the present invention, since a plurality of the contact sections continuous to a front end of the pin section being in the form of a flat plate are arranged in series, it is possible to allow a large amount of run to through the press-fit type connector terminal without an increase in a diameter of a through-hole of a printed circuit board.

Furthermore, since each of the contact sections is in the form of a barrel being able to elastically enlarge or reduce a diameter thereof, a plurality of the contact pieces defining the contact section can be elastically deformed to be inserted into a through-hole when each of the contact sections is inserted into a through-hole of a printed circuit board. Hence, each of the contact sections no longer exerts an excessive compression force (contact pressure) onto an inner surface of a through-hole. Accordingly, it is possible to reduce a force with which the press-fit type connector terminal is inserted into a through-hole formed through a printed circuit board, prevent the contact sections from being plastically deformed when the press-fit type connector terminal is inserted into a through-hole, prevent a printed circuit board from being whitened, and further prevent a plated surface of a through-hole from being degraded. Furthermore, since each of the contact pieces inserted into a through-hole makes contact with an inner surface of the through-hole at a plurality of sites, keeping a force with which the contact piece enlarges a diameter thereof, by virtue of elasticity thereof, it is possible to prevent occurrence of contact defectiveness, and provide superior contact reliability.

In addition, since the press-fit type connector terminal in accordance with the present invention can be formed by bending a single metal plate having elasticity, it is possible to reduce a number of parts and reduce fabrication costs. Comparing the "<"-shaped contact piece to the arcuate contact piece, the arcuate contact piece tends to have a higher yield strength, and hence, does not degrade until it deforms in a relatively much degree. Thus, the arcuate contact piece is superior to the "<"-shaped contact piece for enhancing repeatability with which the press-fit type connector terminal is inserted into and pulled out of a through-hole.

The press-fit type connector terminal may be designed to further include an inner shaft section situated in the contact section and continuous with at least one of the pin section and the contact piece.

By so designing the press-fit type connector terminal, since the inner shaft section is surrounded by a plurality of the contact pieces in the contact section, it is possible to insert the press-fit type connector terminal perpendicularly to a printed circuit board when the press-fit type connector terminal is inserted into a through-hole of the printed circuit board, ensuring enhancement in contact reliability by virtue of the contact pieces facing one another.

It is preferable that the contact pieces are equally spaced away from adjacent ones.

By so designing the contact pieces, each of the contact pieces makes contact with an inner surface of a through-hole at a plurality of sites at an equal pitch, keeping a force for enlarging a diameter thereof, ensuring that contact reliability can be enhanced.

The inner shaft section may be designed to be formed at an outer surface thereof with a protrusion protruding towards the contact pieces.

By so designing the inner shaft section, it is possible to prevent the excessive deformation of the contact pieces caused by reduction in a diameter of the contact pieces, by virtue of the protrusion, when the contact section of the press-fit type connector terminal is inserted into a through-hole formed through a printed circuit board, ensuring that repeatability with which the press-fit type connector terminal is inserted into and pulled out of a through-hole can be enhanced.

It is preferable that the press-fit type connector terminal further includes C-shaped binders arranged around distal and proximal ends of the contact piece so as to surround the imaginary center line.

By designing the press-fit type connector terminal to further include the C-shaped binders, it is possible to stably arrange a plurality of the contact pieces, ensuring that contact reliability can be enhanced.

It is preferable that the press-fit type connector terminal further includes a tapered inclining section at a distal end of the binder situated at a distal end of each of the contact pieces.

By designing the press-fit type connector terminal to further include the tapered inclining section, since the tapered inclining section continuous to a distal end of the binder makes contact with an inner surface of a through-hole at an opening of the through-hole, and then, is guided into the through-hole when the contact section of the press-fit type connector terminal is inserted into the through-hole of a printed circuit board, ensuring insertability of the contact section into a through-hole can be enhanced.

It is preferable that the press-fit type connector terminal further includes a shoulder having a portion protruding beyond an outer surface of the contact section, the shoulder being situated between the pin section and the contact section.

By designing the press-fit type connector terminal to further include the shoulder, since it is possible to exert a compression force on the shoulder having a portion protruding beyond an outer surface of the pin section, in order to insert the contact section into a through-hole formed through a printed circuit board, ensuring that workability with which the contact section is inserted into a through-hole formed through a printed circuit board can be enhanced.

It is preferable that the metal plate includes a first area for forming the pin section, the first area being in the form of a flat plate, a second area for forming a plurality of the contact sections, the second area being continuous to a front end of the first area, and a third area for forming a plurality of the inner shaft sections, the third area being continuous to a front end of the second area, the second area being substantially rectangular, having a width smaller than the same of the first area, and including a plurality of slits extending in parallel with a longitudinal axis of the first area, the third area being band-shaped and having a width smaller than the same of the second area.

By so designing the metal plate, it is possible to form the press-fit type connector terminal by folding the third area around a fold line longitudinally extending in the third area, folding the third area by 180 degrees towards the second area around the fold line, and bending the second area such that the second area surrounds the third area, ensuring that a fabrication yield can be enhanced.

The metal plate may be designed to includes a first area for forming the pin section, the first area being in the form of a flat plate, and a second area for forming a plurality of the contact sections, the second area being continuous to a front end of the first area, the second area being substantially rectangular, and having a width smaller than the same of the first area.

By so designing the metal plate, it is possible to readily form the press-fit type connector terminal including a plurality of the contact sections being in the form of a barrel or a spindle, continuous to a front end of the pin section being in the form of a flat plate.

The metal plate may be designed to include a first area for forming the pin section, the first area being in the form of a flat plate, a second area for forming a plurality of the contact sections, the second area being continuous to a front end of the first area, a third area for forming a plurality of the inner shaft sections, the third area being continuous to a front end of the second area, and a fourth area for forming the shoulder, the fourth area being located between the first area and the second area, the second area being substantially rectangular, having a width smaller than the same of the first area, and including a plurality of slits extending in parallel with a longitudinal axis of the first area, the third area being band-shaped and having a width smaller than the same of the second area.

By so designing the metal plate, it is possible to form the shoulder by bending the metal plate, ensuring that an efficiency in steps for fabricating the press-fit type connector terminal can be enhanced.

The metal plate may be designed to further include a band-shaped third area for forming an inner shaft section, the third area having a width smaller than the same of the second area, the third area being situated continuous to a front end of the second area or between the first area and the second area.

By so designing the metal plate, it is possible to readily form the press-fit type connector terminal including the inner shaft section within the contact section being in the form of a barrel or a spindle.

The third area may be designed to include a fifth area for forming a protrusion, the fifth area protruding beyond the third area in both width-wise and thickness-wise directions of the third area, the protrusion being formed at an outer surface of the inner shaft section and protruding towards the contact piece.

By so designing the metal plate, it is possible to readily form the protrusion at an outer surface of the inner shaft section, protruding towards the contact pieces.

The advantages obtained by the aforementioned present invention will be described hereinbelow.

The present invention provides the press-fit type connector terminal which is capable of allowing a large amount of current to run therethrough without an increase in a diameter of a through-hole of a printed circuit board, reducing a force by which the press-fit type connector terminal is inserted into a through-hole of a printed circuit board, preventing a contact section from being plastically deformed when inserted into a through-hole of a printed circuit board, preventing a printed circuit board from being whitened, and presenting superior contact reliability.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

Figure 1:
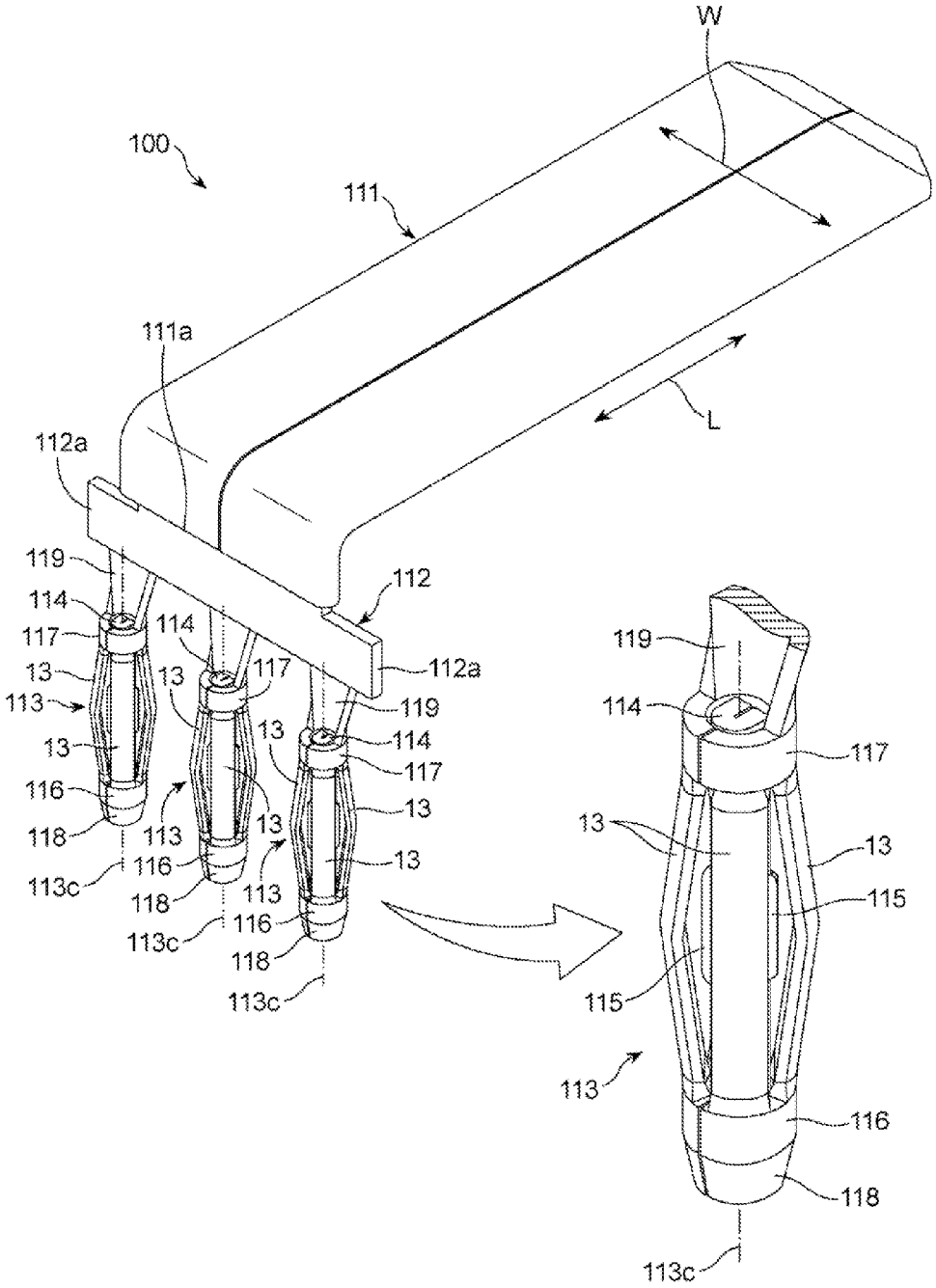
FIG. 1 is a perspective view of the press-fit type connector terminal in accordance with the first embodiment of the present invention.

The press-fit type connector terminal 100 in accordance with the first embodiment of the present invention is explained hereinbelow with reference to FIGS. 1 to 8.

As illustrated in FIGS. 1 to 5, the press-fit type connector terminal 100 is formed by bending a single metal plate 110 (see FIGS. 8A and 8B) having elasticity.

The press-fit type connector terminal 100 includes a pin section 11 in the form of a flat plate, a plurality of contact sections 113 continuous to a front end of the pin section 111, and a shoulder 112 situated between a front end of the pin section 111 and the contact sections 113 and being in the form of a flat plate.

Each of the contact sections 113 includes a plurality of "<"-shaped contact pieces 13 extending along an imaginary center line 113*c* and outwardly protruding so as to surround the imaginary center line 113*c*.

An inner shaft section 114 continuous to the contact piece 113 stands coaxially with the imaginary center line 113*c* in each of the contact sections 113. In each of the contact sections 113, a plurality of the contact pieces 13 is arranged around the inner shaft section 114 having a U-shaped cross-section such that the contact sections 113 are equally spaced away from adjacent ones. Each of the contact sections 113 is entirely in the form of a barrel. Each of the contact sections 113 being in the form of a barrel around the inner shaft section 114 is able to elastically enlarge and reduce a diameter thereof. As best illustrated in FIG. 7, protrusions 115 protrude towards the contact pieces 13 from an outer surface of the inner shaft section 114.

Each of the contact sections 113 is formed at both distal and proximal ends of the contact pieces 13 with C-shaped binders 116 and 117 surrounding the inner shaft section 114. The binder 116 situated at front ends of the contact pieces 13 has a tapered inclining section 118 at a front end thereof. The rectangular shoulder 112 situated between the pin section 111 and the contact sections 113 and being in the form of a flat plate has a surface extending in parallel with a direction in which the contact sections 113 are arranged. The shoulder 112 has opposite ends 112*a* located beyond outer surfaces of the contact pieces 113 located at left and right ends of a line of the contact sections 113. A tapered connector 119 is situated between each of the contact sections 113 and the shoulder 112. The connector 119 has a width reducing towards the contact section 113.

The pin section 111 being substantially rectangular and being in the form of a flat plate is perpendicularly folded in the vicinity of a front end 111*a* in a length-wise direction L thereof. The shoulder 112, the connector 119 and the contact sections 113 are arranged continuous to the front end 111*a*. Thus, a direction in which the contact sections 113 are inserted into through-holes of a printed circuit board and the length-wise direction L of the pin section 111 are perpendicular to each other. A distance between the opposite ends 112*a* of the shoulder 112 is greater than a length of the pin section 111 measured in a width-wise direction W thereof.

Figure 6:
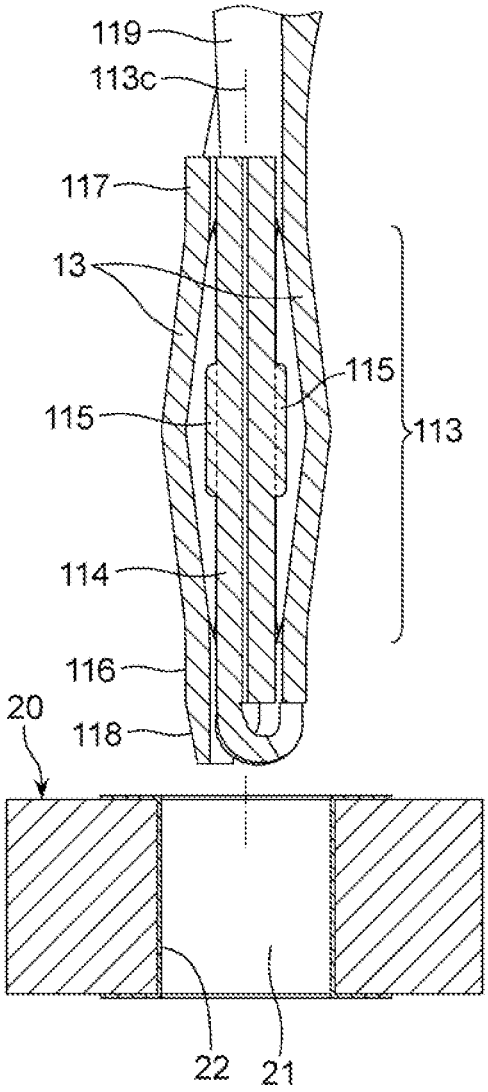
FIG. 6 is a partial cross-sectional view showing the press-fit type connector terminal illustrated in FIG. 1, before inserted into a through-hole formed through a printed circuit board.
Figure 7:
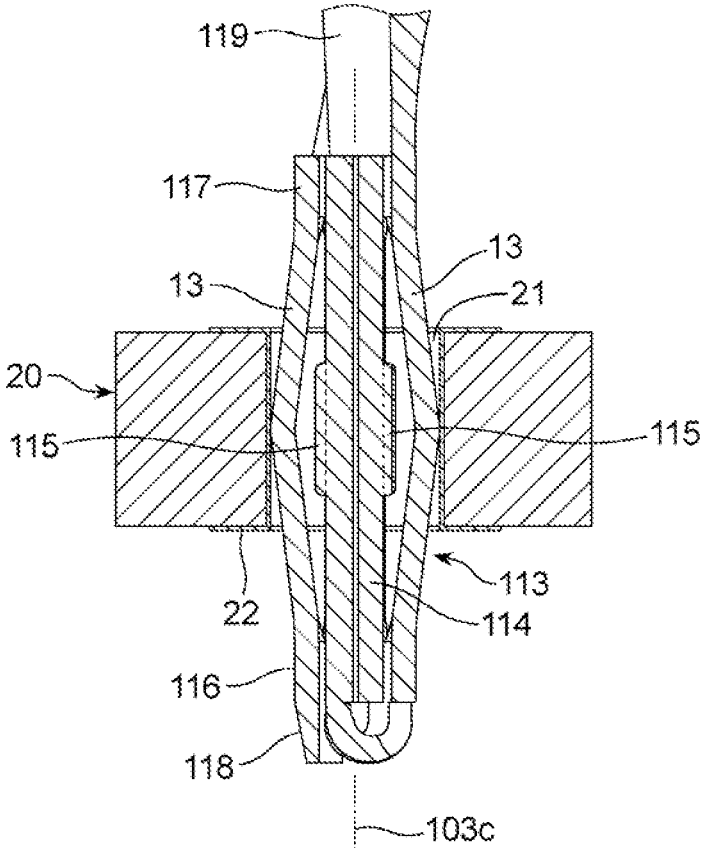
FIG. 7 is a partial cross-sectional view showing the press-fit type connector terminal illustrated in FIG. 1, after having been inserted into a through-hole formed through a printed circuit board.

As illustrated in FIGS. 6 and 7, since a plurality of the contact pieces 13 defining the contact section 113 elastically deforms such that they come close to the inner shaft section 114, and is inserted into a through-hole 21 when the contact section 113 is inserted into the through-hole 21 plated with a metal 22 and formed through a printed circuit board 20, it is possible to reduce a force with which the contact section 113 is inserted into the through-hole 21. Furthermore, since the contact section 113 no longer exerts an excessive compression force (contact pressure) onto an inner surface of the through-hole 21, a plated surface of the through-hole 21 is not degraded, and it is possible to prevent the printed circuit board 20 from being whitened. In addition, even if the pin section 111 were inclined, the contact pieces 13 would be difficult to be elastically deformed, because the contact pieces 13 make contact with the inner shaft section 114.

Furthermore, since the contact pieces 13 defining the contact section 113 having been inserted into the through-hole 21 equally makes contact with an inner surface of the through-hole 21 at a plurality of sites, keeping a force by which the contact pieces 13 enlarge a diameter thereof, contact defectiveness would not occur, and superior contact reliability is provided. In addition, a plurality of the contact sections 113 continuous to the pin section 111 being in the form of a flat plate allows a large amount of current to run therethrough without an increase in a diameter of the through-hole 21 of the printed circuit board 20.

Figure 2:
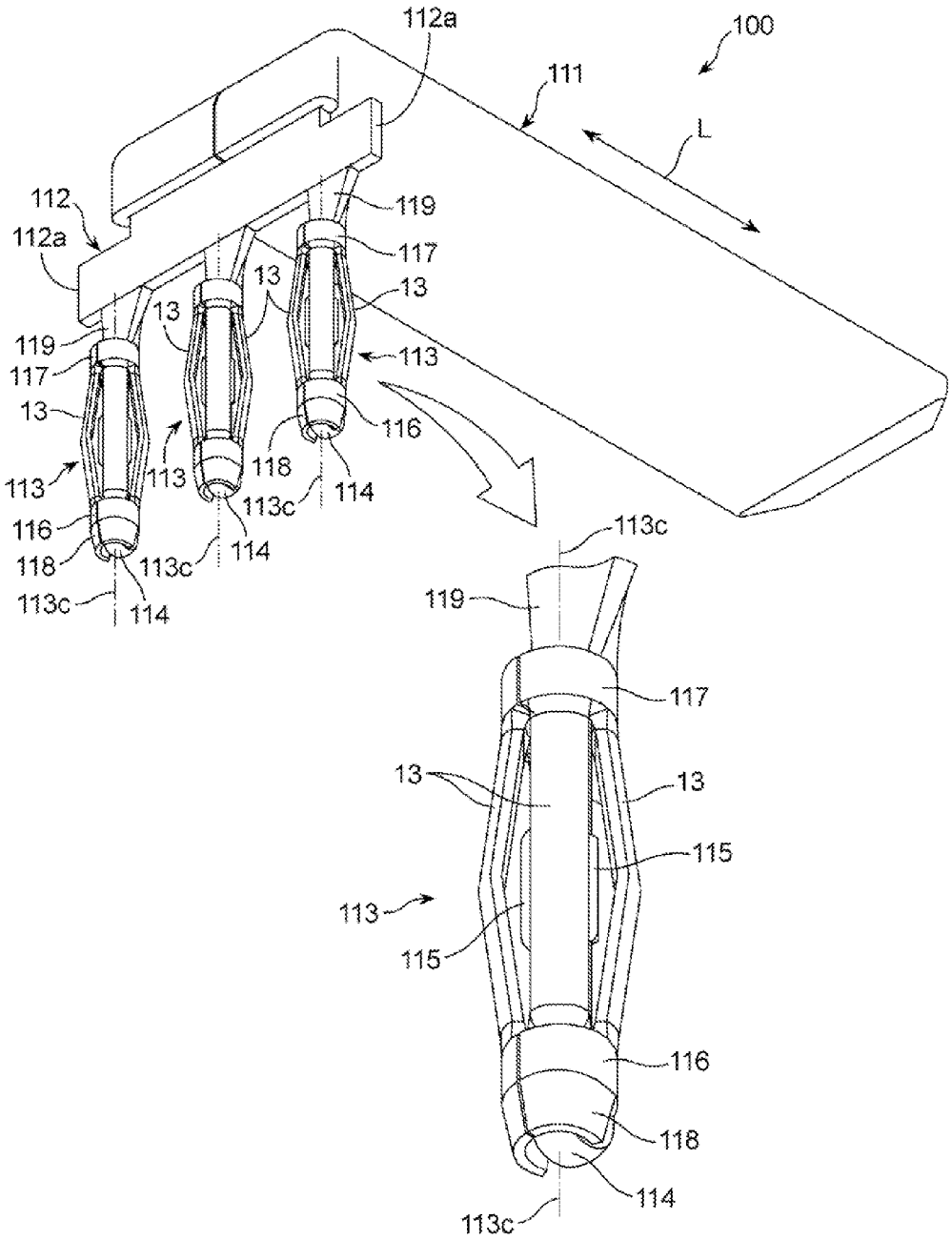
FIG. 2 is a perspective view of the press-fit type connector terminal illustrated in FIG. 1, viewing in a different angle from FIG. 1.
Figure 3:
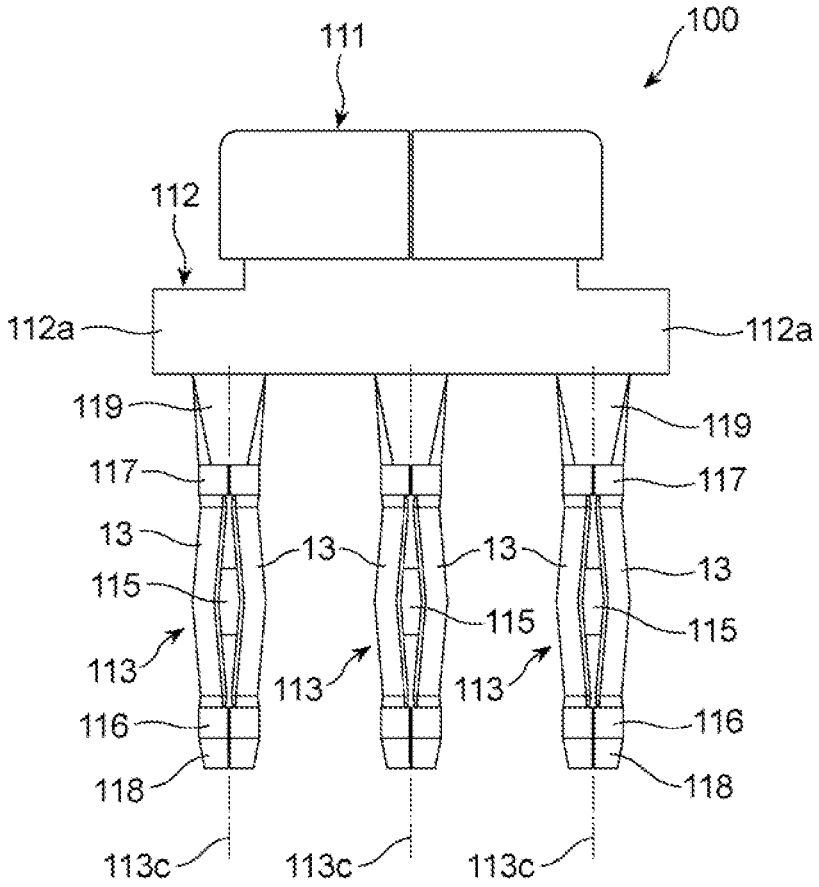
FIG. 3 is a front view of the press-fit type connector terminal illustrated in FIG. 1.
Figure 4:
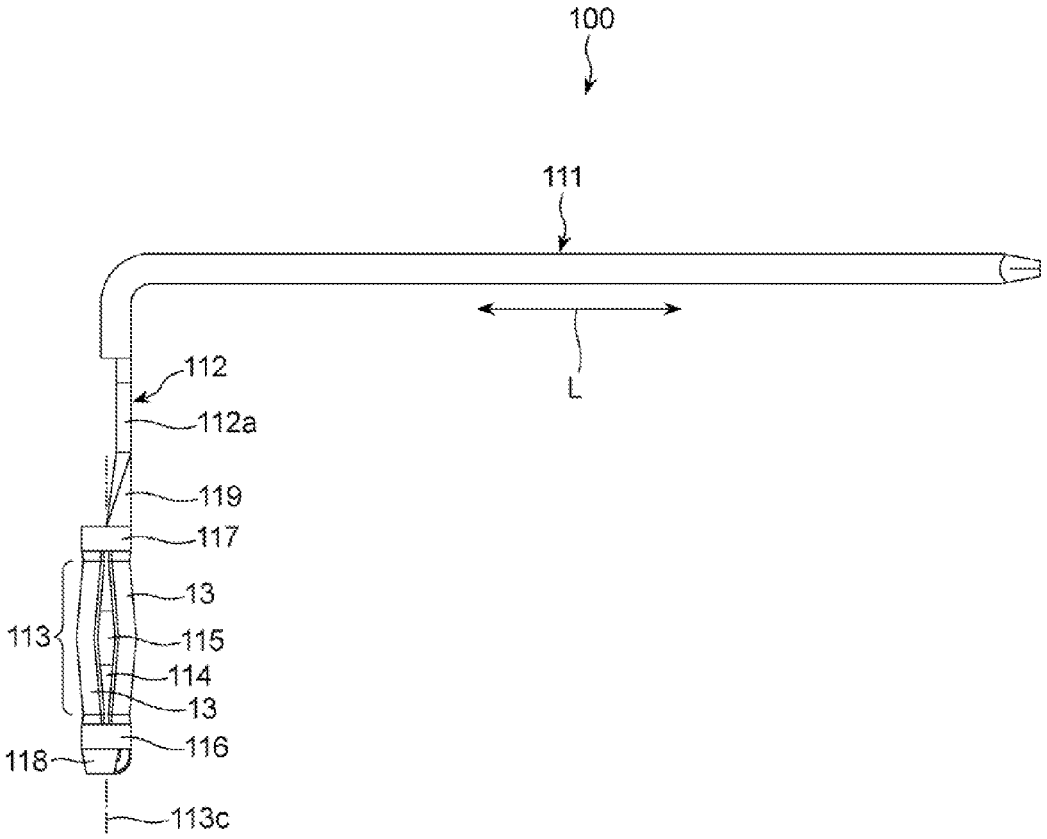
FIG. 4 is a right-side view of the press-fit type connector terminal illustrated in FIG. 1.
Figure 5:
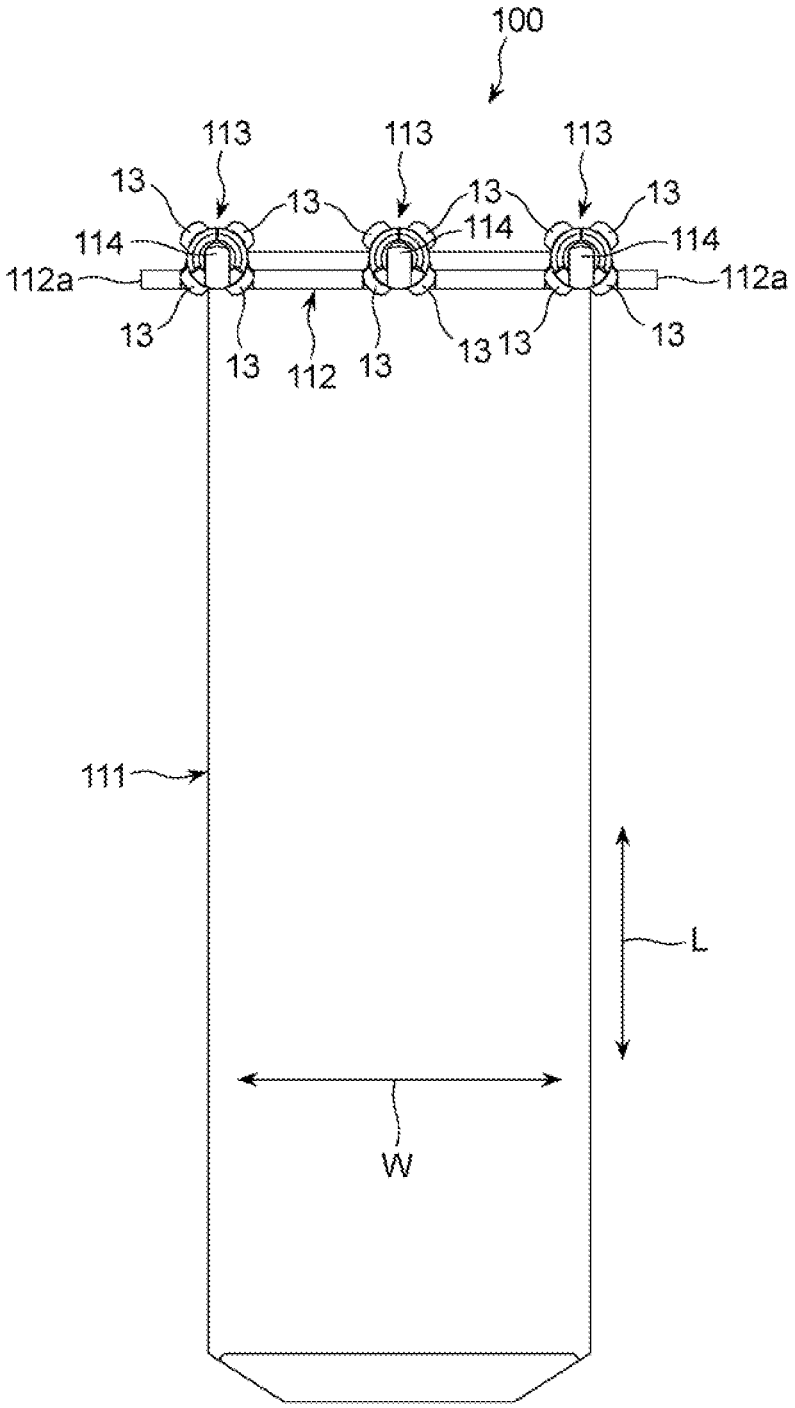
FIG. 5 is a bottom view of the press-fit type connector terminal illustrated in FIG. 1.

In addition, as illustrated in FIGS. 1 and 2, since C-shaped binders 116 and 117 surround the inner shaft section 114 at distal and proximal ends of each of the contact pieces 13, the contact pieces 13 can be stably arranged both when the contact section 113 is inserted into the through-hole 21 and after the contact section 113 was inserted into the through-hole 21, as illustrated in FIGS. 6 and 7, ensuring that contact reliability can be enhanced.

Since the press-fit type connector terminal 100 is designed to have the protrusions 115 protruding towards the contact pieces 13, at an outer surface of the inner shaft section 114, it is possible to prevent, by virtue of the protrusions 115, the excessive deformation of the contact pieces 13 which is caused by the shrinkage in a diameter of the contact section 113 when the contact section 113 is inserted into the through-hole 21 formed through the printed circuit board 20, as illustrated in FIG. 6. Thus, it is possible to enhance the repeatability with which the press-fit type connector terminal 100 is inserted into and pulled out of the through-hole 21.

Furthermore, since the press-fit type connector terminal 100 is designed to include the tapered inclining section 118 at a distal end of the binder 116 situated at a distal end of each of the contact pieces 13, when the contact section 113 is inserted into the through-hole 21 of the printed circuit board 20, as illustrated in FIG. 6, the tapered inclining section 118 situated at a distal end of the binder 116 makes contact with an inner surface of the through-hole 21 at an opening of the through-hole 21, and then, is guided into the through-hole 21, ensuring insertability of the contact section 113 into the through-hole 21 can be enhanced.

Though each of the contact pieces 13 is designed to be "<"-shaped, each of the contact pieces 13 may be designed to be arcuate.

Figure 8A:
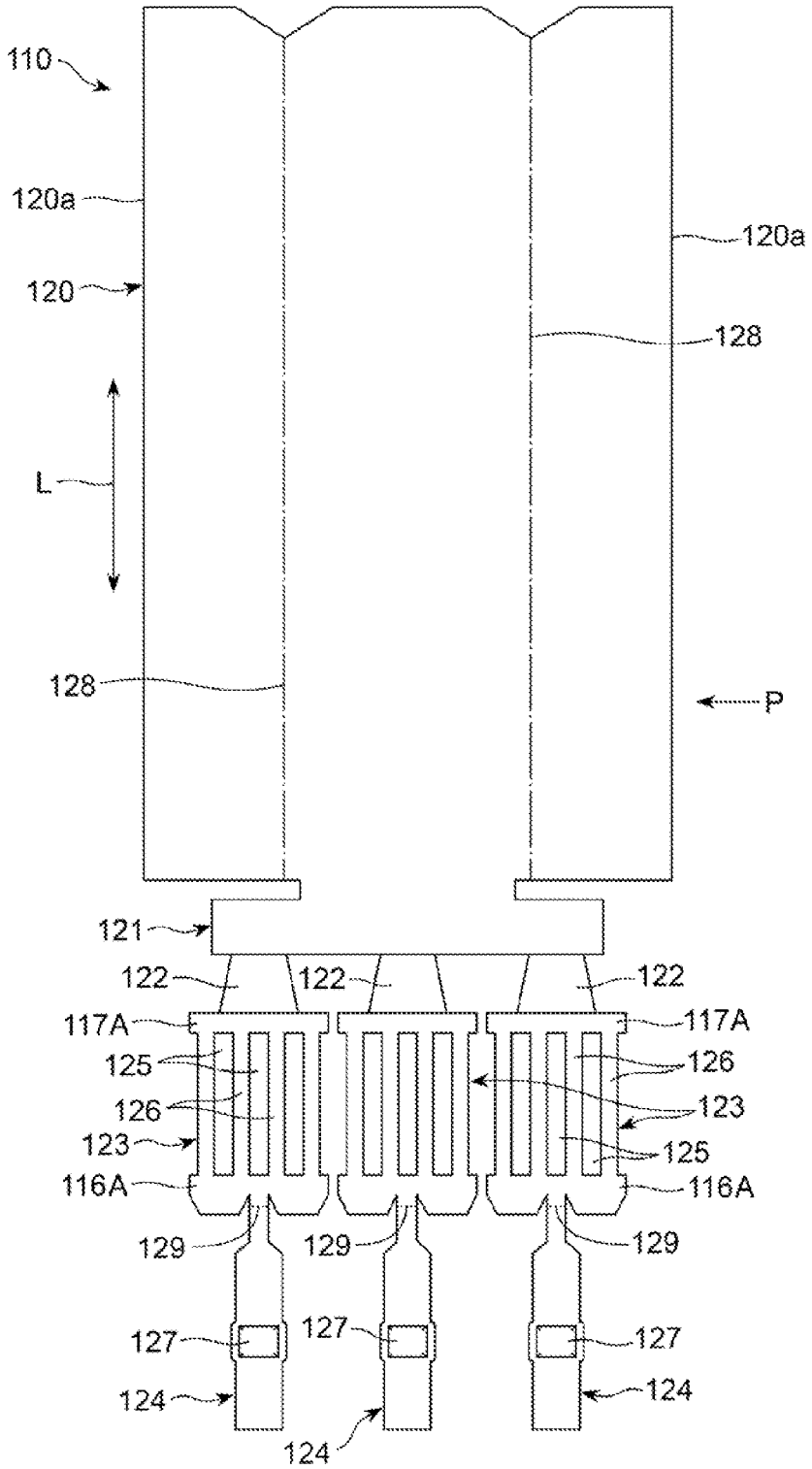
FIG. 8A is a view illustrating a developed metal plate from which the press-fit type connector terminal illustrated in FIG. 1 is fabricated.
Figure 8B:
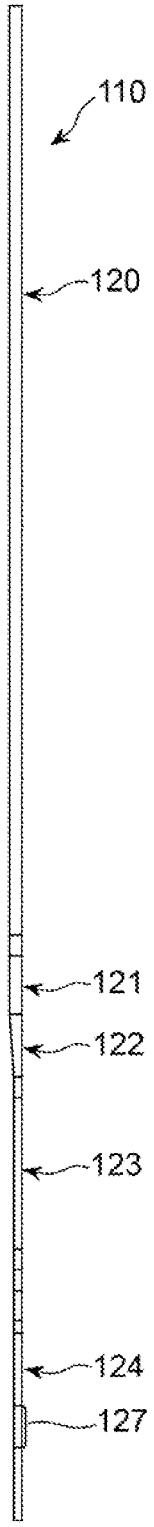
FIG. 8B is a view viewing in a direction indicated with an arrow P shown in FIG. 8A.
Figure 9:
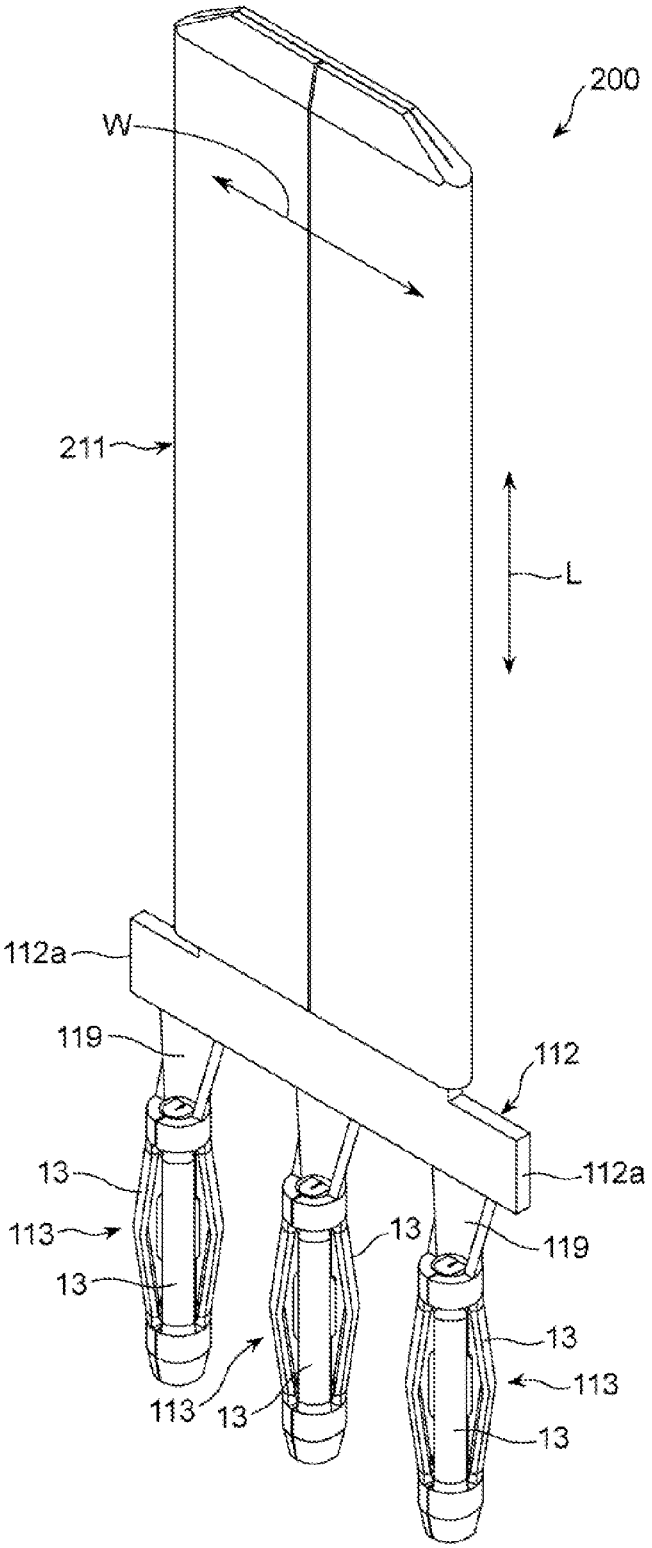
FIG. 9 is a perspective view of the press-fit type connector terminal in accordance with the second embodiment of the present invention.
Figure 10:
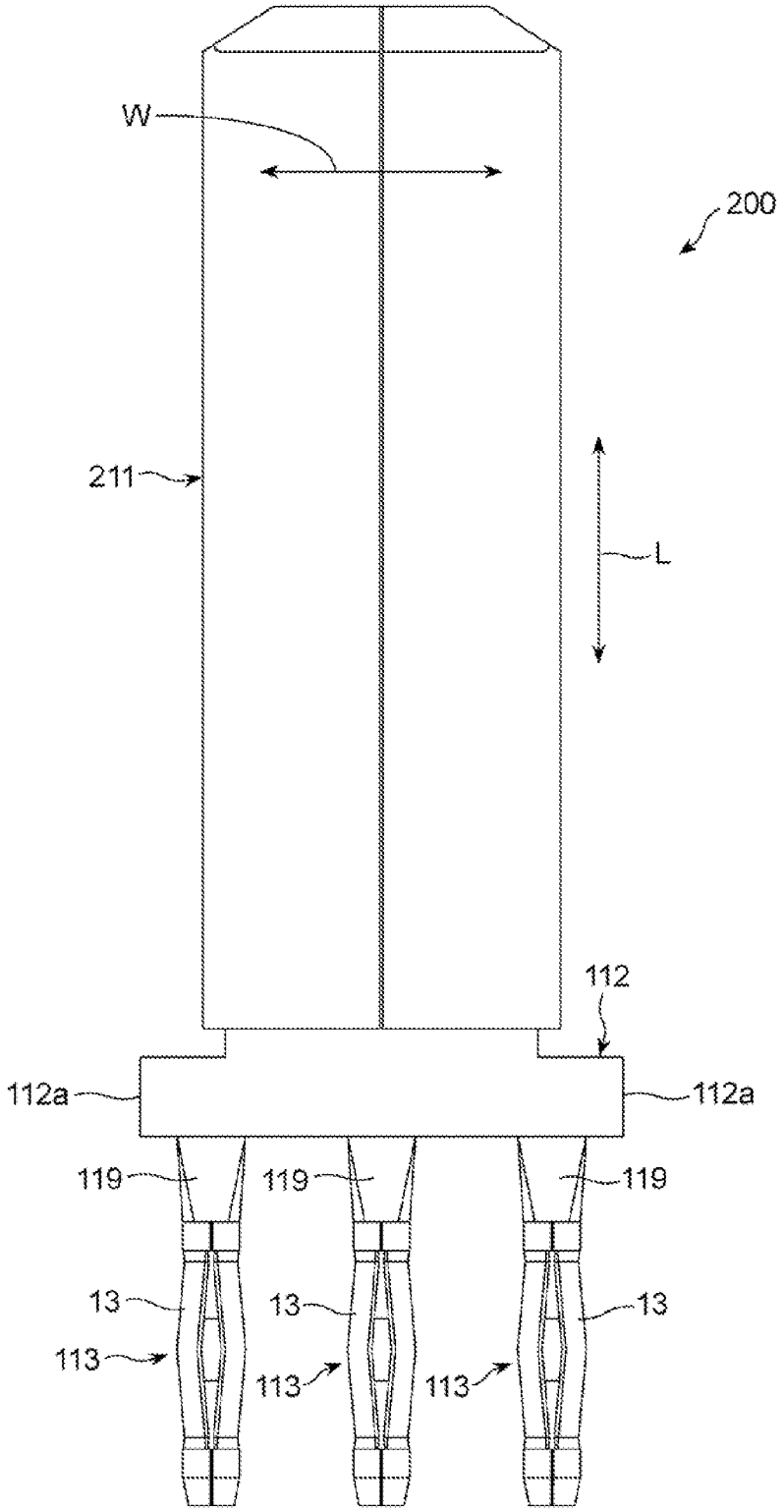
FIG. 10 is a front view of the press-fit type connector terminal illustrated in FIG. 9.
Figure 11:
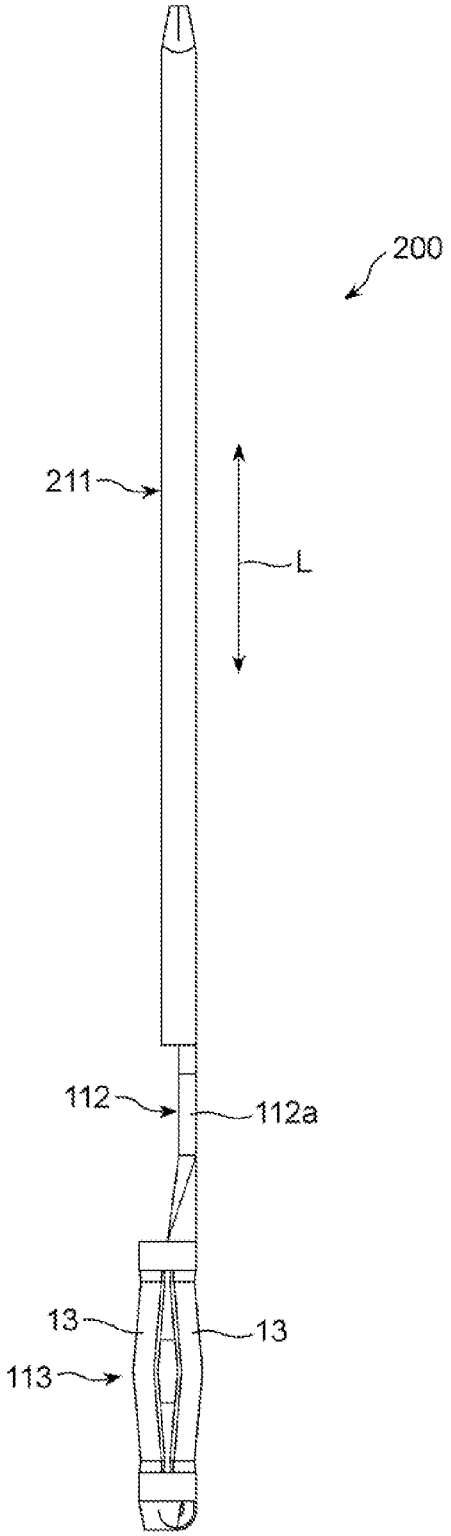
FIG. 11 is a right-side view of the press-fit type connector terminal illustrated in FIG. 9.
Figure 12:
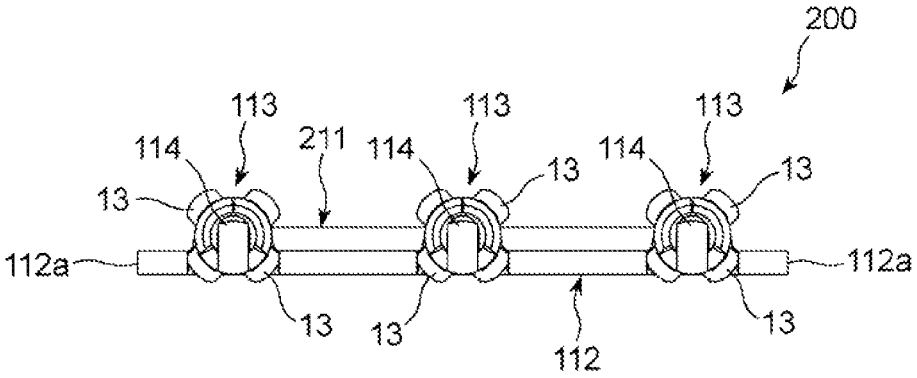
FIG. 12 is a bottom view of the press-fit type connector terminal illustrated in FIG. 9.

The press-fit type connector terminal 100 is formed by bending a single metal plate 110 having elasticity, illustrated in FIGS. 8A and 8B. As illustrated in FIGS. 8A and 8B, the metal plate 110 formed by pressing includes a substantially rectangular first area 120 for forming the pin section 111, a substantially rectangular fourth area 121 for forming the shoulder 112, continuous to a front end of the first area 120, a plurality of sixth areas 122 each for forming the tapered connector 119, continuous to a front end of the fourth area 121, a plurality of second areas 123 each for forming the contact section 113, continuous to a front end of each of the sixth areas 122, and a plurality of third areas 124 each for forming the inner shaft section 114, continuous to a front end of each of the second areas 123.

Each of the second areas 123 is in the form of a rectangle having a width greater than a width of the fourth area 121, and has a plurality of slits 125 and strips 126 both extending in parallel with a length-wise direction L of the first area 120. The third area 124 has a width smaller than a width of the second area 123, and is band-shaped. The third area 124 is centrally formed with a fifth area 127 for forming the protrusion 115. The fifth area 127 protrudes beyond the third area 124 in both width-wise and thickness-wise directions of the third area 124.

The press-fit type connector terminal 100 illustrated in FIG. 1 is formed by bending the metal plate 110 illustrated in FIGS. 8A and 8B as follows.

First, the opposite ends 120*a* of the first area 120 are folded by 180 degrees towards a center of the first area 120 around two fold lines 128 extending in a length-wise direction L of the first area 120. Thus, the pin section 111 (see FIG. 1) is formed.

Then, the third area 124 is folded along a length-wise direction thereof such that the third area 124 has a U-shaped cross-section, to thereby form the inner shaft section 114 (see FIG. 1). Then, the inner shaft section 114 is folded by 180 degrees towards the second area 123 along a fold line 129 extending between the third area 124 and the second area 123. By folding the third area 124 to have a U-shaped cross-section, the protrusion 115 (see FIG. 1) is formed by the fifth area 127.

Then, each of the strips 126 of the second area 123 is folded in the "<"-shaped form, areas 116A and 117A for forming the binders 116 and 117 are folded in the C-shaped form around the inner shaft section 114, and each of the second areas 123 is folded in the barrel form to surround the inner shaft section 114. Thereby, there is formed a plurality of the contact sections 113. Then, as illustrated in FIG. 1, the pin section 111 being in the form of a flat plate is perpendicularly folded at a portion which is in the vicinity of the front end 111*a* in a length-wise direction L.

The press-fit type connector terminal 100 in accordance with the first embodiment is designed to include the three contact sections 113. A number of the contact sections 113 is not to be limited to three, but may be determined in dependence on a use thereof and/or conditions in accordance with which the contact sections 113 are employed.

Though the press-fit type connector terminal 100 in accordance with the first embodiment is designed to include the inner shaft section 114 in the contact section 113, the press-fit type connector terminal 100 may be designed not to include the inner shaft section 114 in the contact section 113.

Second Embodiment

The press-fit type connector terminals 200, 300, 400, 500, 600, 700, 800 and 900 in accordance with the second to ninth embodiments are explained hereinbelow with reference to FIGS. 9 to 32B. Parts or elements that correspond to those of the above-mentioned press-fit type connector terminal 100 illustrated in FIGS. 1 to 8 have been provided with the same reference numerals, and operate in the same manner as corresponding parts or elements in the press-fit type connector terminal 100, unless explicitly explained hereinbelow.

The press-fit type connector terminal 200 in accordance with the second embodiment, illustrated in FIGS. 9 to 12, is designed to include a pin section 211 in the form of a flat plate not folded. A direction in which each of the contact sections 113 is inserted into and pulled out of the through-hole 21 (see FIG. 6) of the printed circuit board 20 is in parallel with a length-wise direction L of the pin section 211.

By so designing the pin section 211, it is possible to perpendicularly connect the press-fit type connector terminal 200 to the printed circuit board 20.

Third Embodiment

The press-fit type connector terminal 300 in accordance with the third embodiment, illustrated in FIGS. 13 to 17, is designed to include a shoulder 312 having a double-wall structure. Specifically, as illustrated in FIGS. 17A and 17B, a metal plate 310 from which the press-fit type connector terminal 300 is formed is designed to include a band-shaped fourth area 321 extending in parallel with a width-wise direction (see FIG. 13) of the pin section 111, between the first area 120 for forming the pin section 111 and the sixth areas 122 each for forming the connector 119. The shoulder 312 is formed by folding the fourth area 321 around two fold lines 329 extending in parallel with the fold lines 128. Two areas located outwardly beyond the fold lines 329 define opposite ends 312*a* of the shoulder 312. The opposite ends 312*a* of the shoulder 312 protrude beyond the contact sections 113 located at right and left ends among the contact sections 113 arranged in a width-wise direction W of the pin section 111.

By so designing the shoulder 312, the press-fit type connector terminal 300 can be inserted into a through-hole of a printed circuit board by pushing the shoulder 312.

Figure 13:
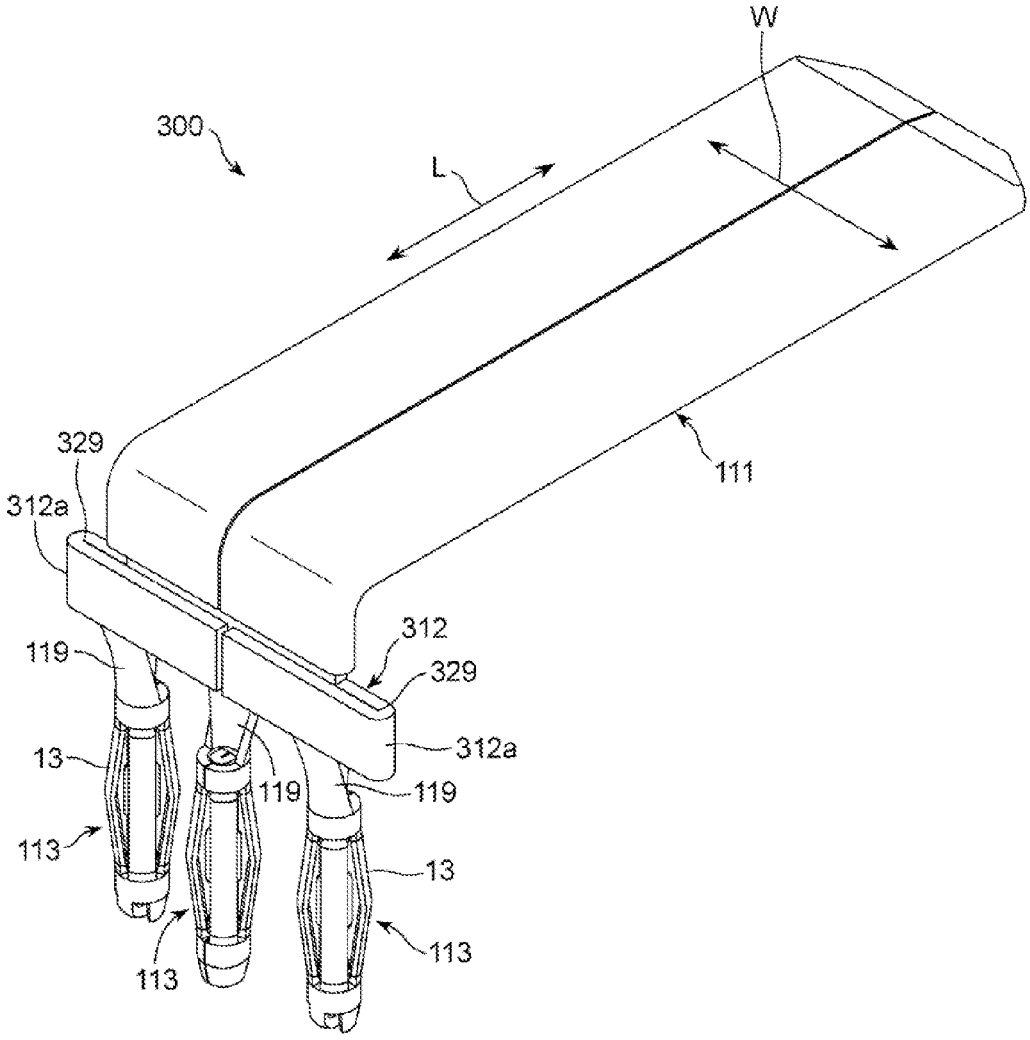
FIG. 13 is a perspective view of the press-fit type connector terminal in accordance with the third embodiment of the present invention.
Figure 14:
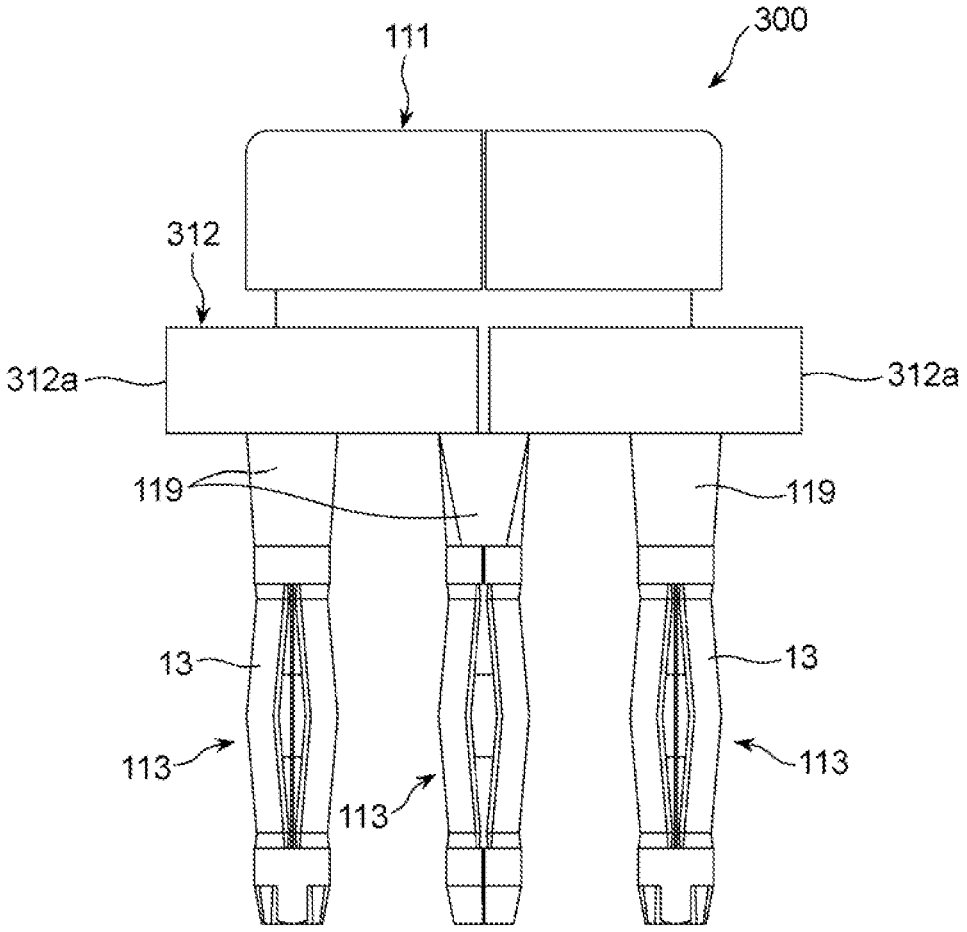
FIG. 14 is a front view of the press-fit type connector terminal illustrated in FIG. 13.
Figure 15:
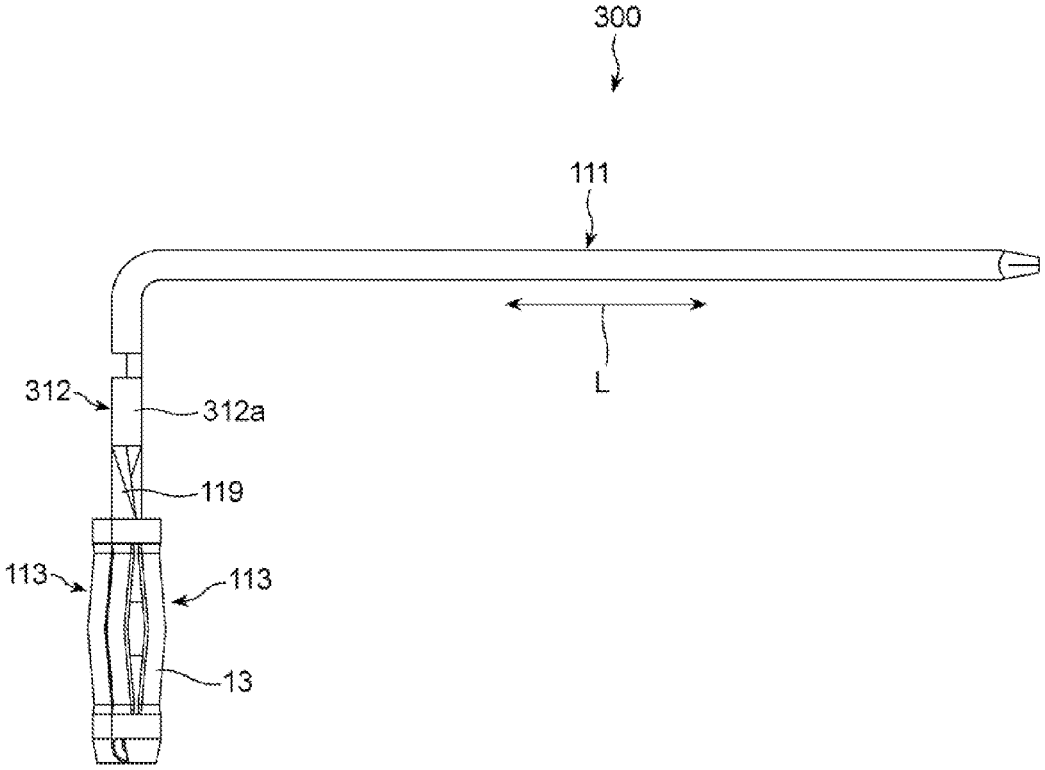
FIG. 15 is a right-side view of the press-fit type connector terminal illustrated in FIG. 13.
Figure 16:
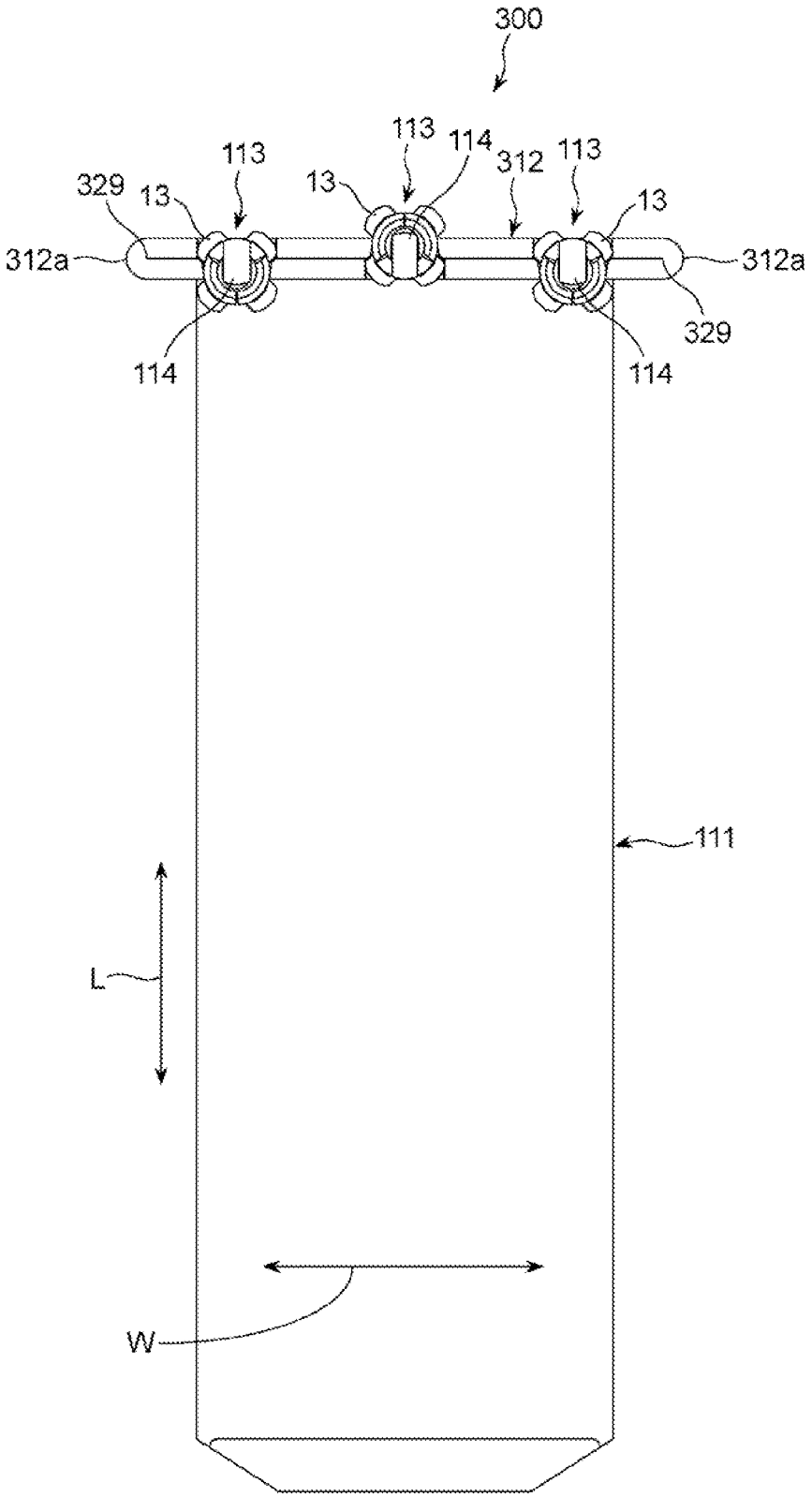
FIG. 16 is a bottom view of the press-fit type connector terminal illustrated in FIG. 13.
Figure 17A:
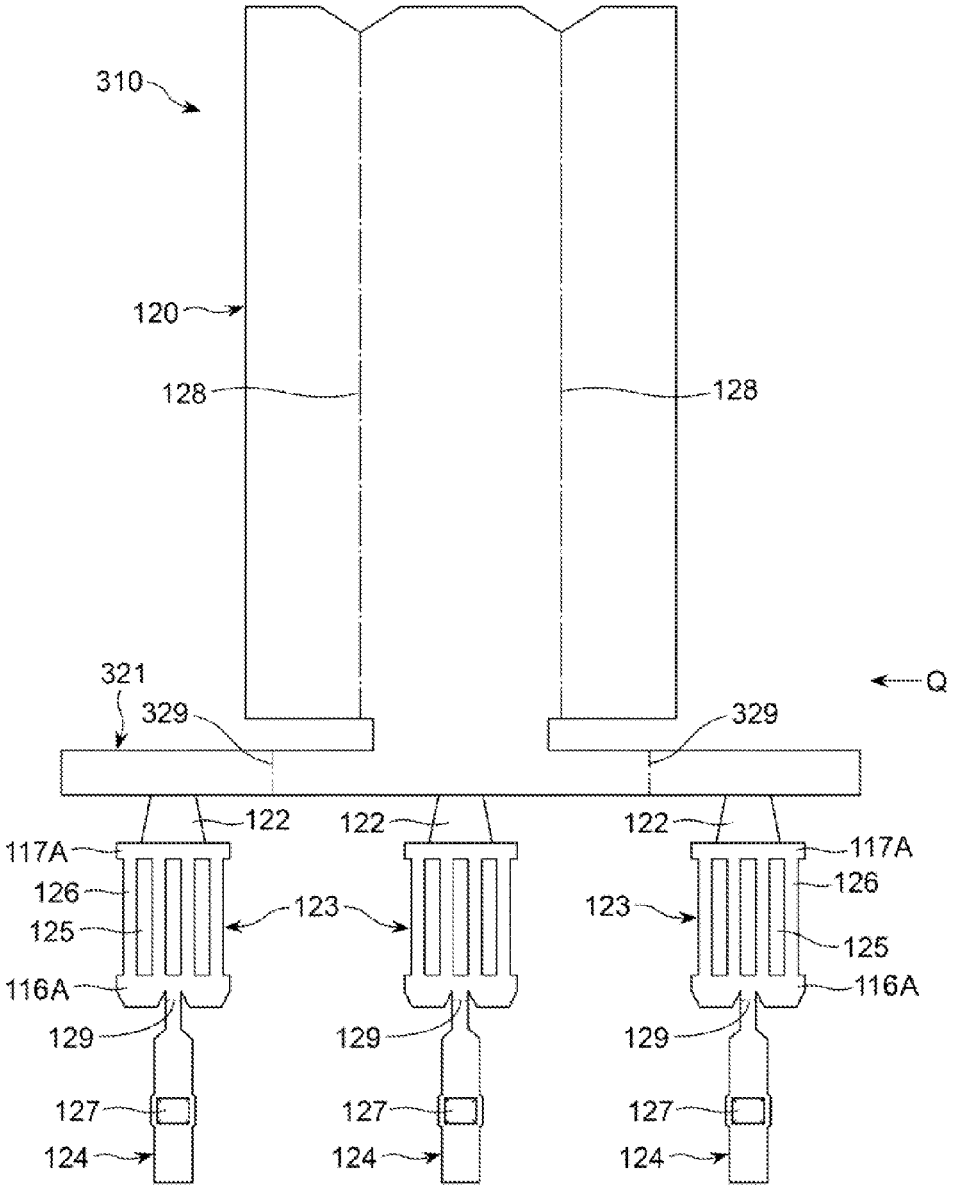
FIG. 17A is a view illustrating a developed metal plate from which the press-fit type connector terminal illustrated in FIG. 13 is fabricated.
Figure 17B:
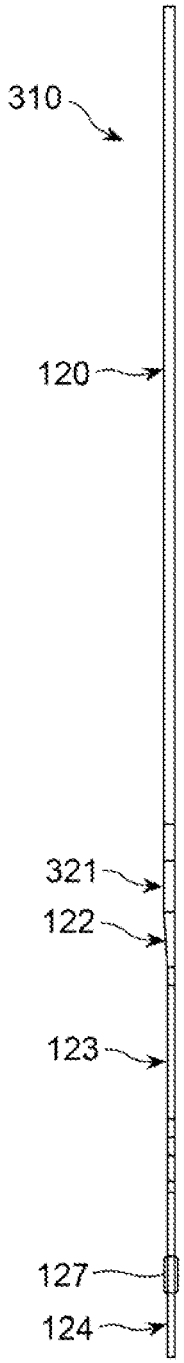
FIG. 17B is a view viewing in a direction indicated with an arrow Q shown in FIG. 17A.
Figure 18:
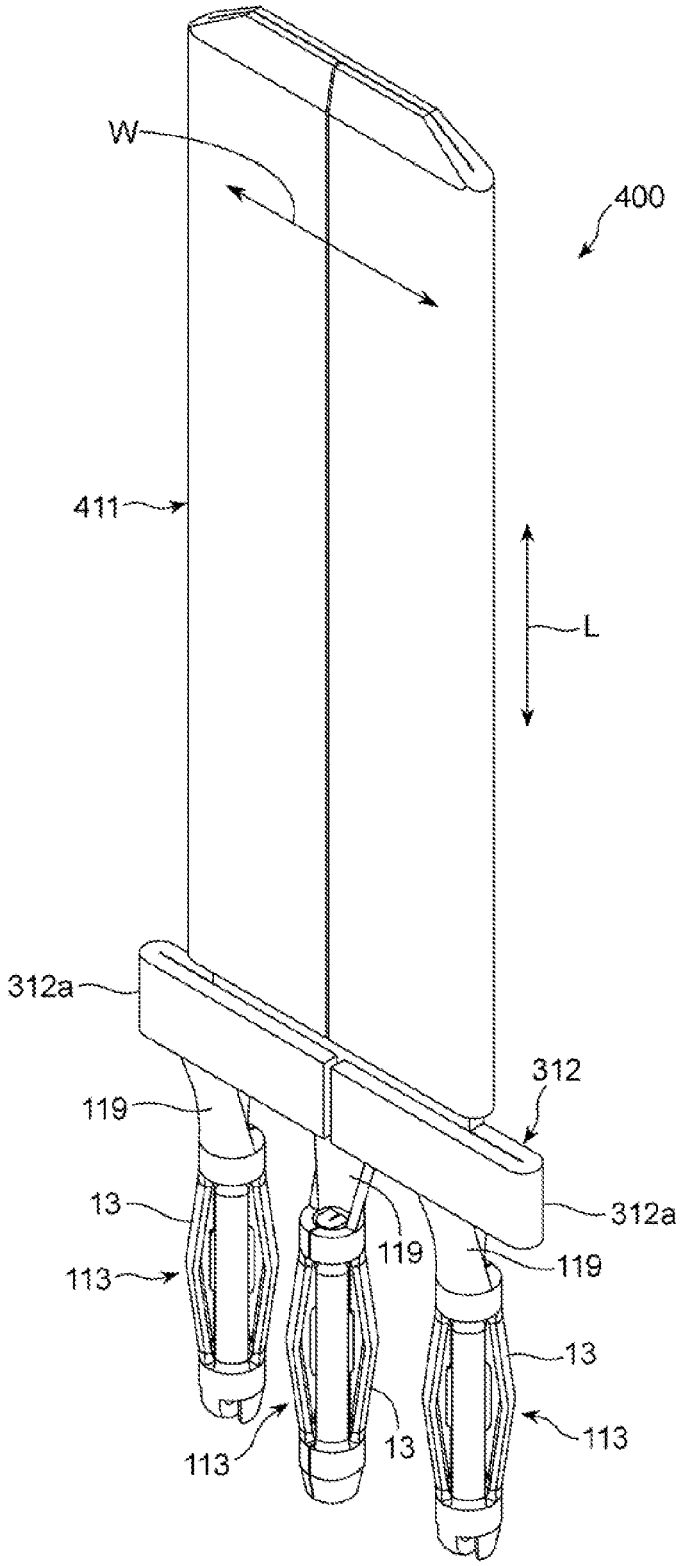
FIG. 18 is a perspective view of the press-fit type connector terminal in accordance with the fourth embodiment of the present invention.
Figure 19:
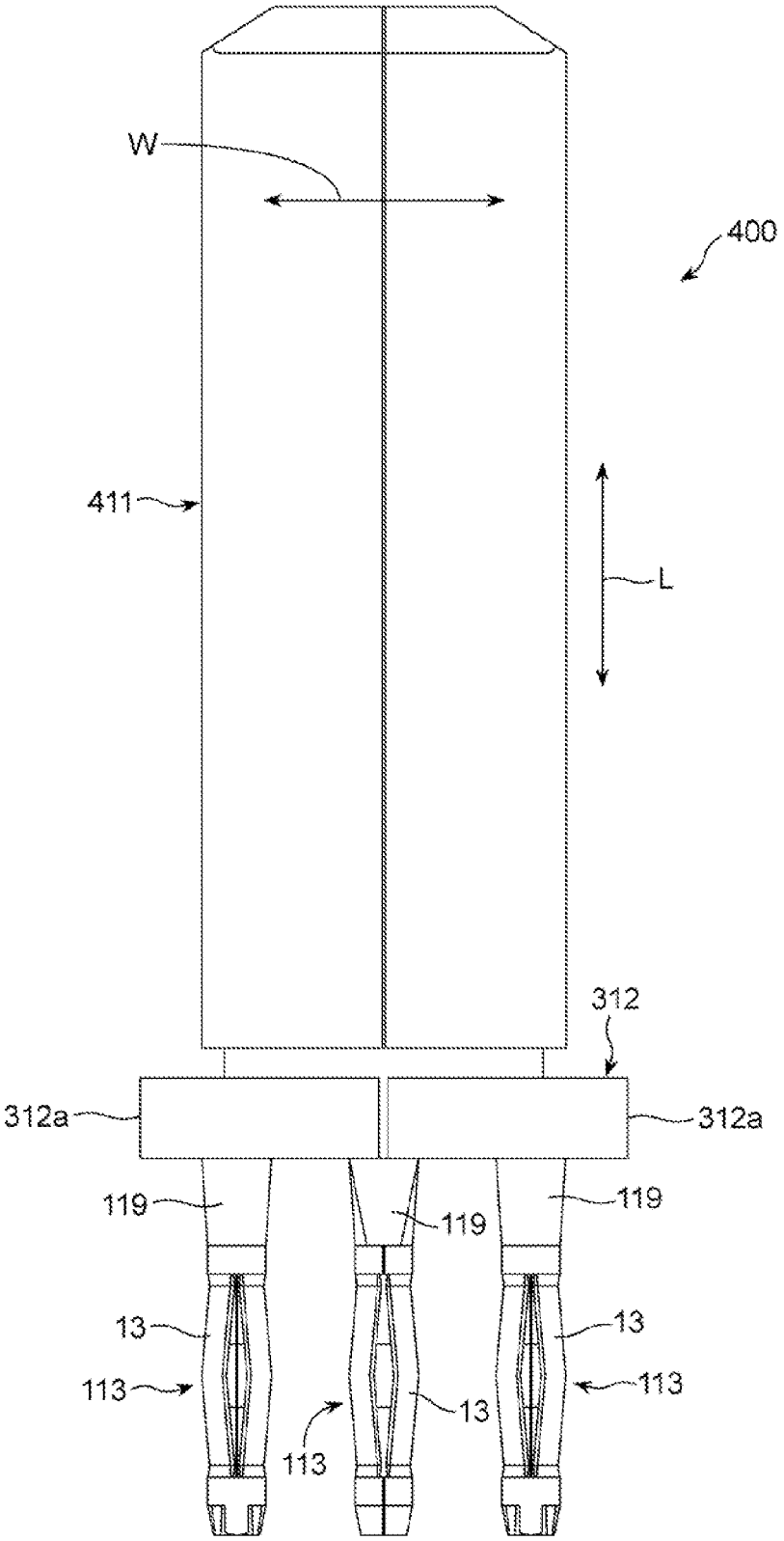
FIG. 19 is a front view of the press-fit type connector terminal illustrated in FIG. 18.
Figure 20:
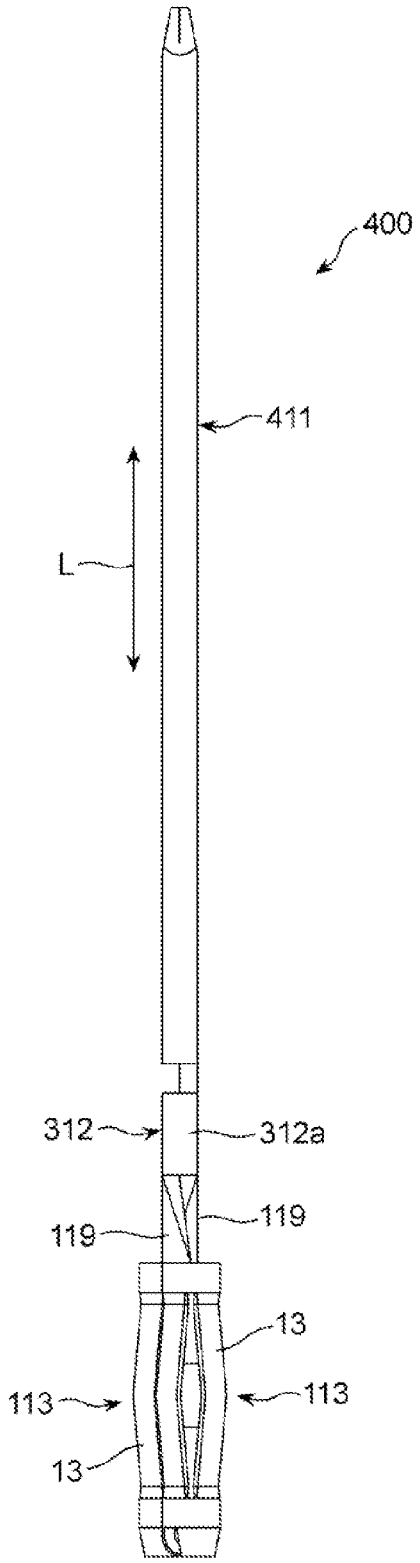
FIG. 20 is a right-side view of the press-fit type connector terminal illustrated in FIG. 18.
Figure 21:
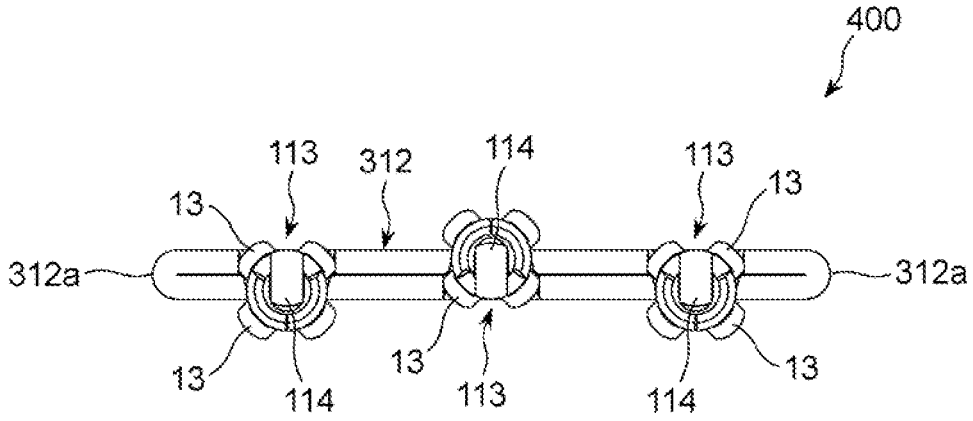
FIG. 21 is a bottom view of the press-fit type connector terminal illustrated in FIG. 18.

In the press-fit type connector terminal 300, as illustrated in FIGS. 13 and 16, the three contact sections 113 arranged in a width-wise direction W of the pin section 111 are alternately rotated by 180 degrees around the inner shaft section 114.

By so designing the three contact sections 113, a distance between the adjacent contact sections 113 can be arbitrarily changed merely by changing a position of the fold lines 329.

Fourth Embodiment

The press-fit type connector terminal 400 in accordance with the fourth embodiment, illustrated in FIGS. 18 to 21, is designed to include a pin section 411 in the form of a flat plate not folded. A direction in which each of the contact sections 113 is inserted into and pulled out of the through-hole 21 (see FIG. 6) of the printed circuit board 20 is in parallel with a length-wise direction L of the pin section 411. Except for the shape of the pin section 411, the press-fit type connector terminal 400 has the same structure and functions as those of the press-fit type connector terminal 300 illustrated in FIG. 13.

By so designing the pin section 411, it is possible to perpendicularly connect the press-fit type connector terminal 400 to the printed circuit board 20.

Fifth Embodiment

Figure 22:
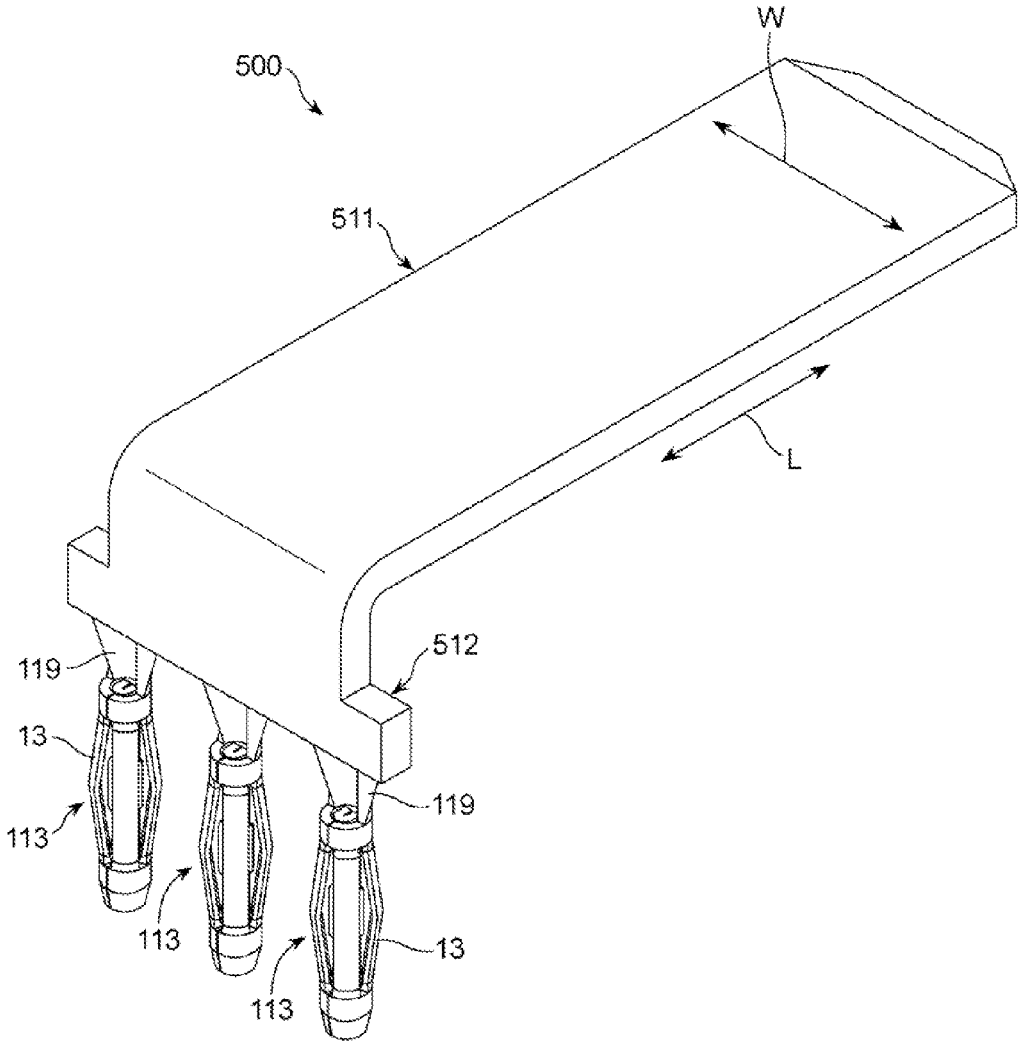
FIG. 22 is a perspective view of the press-fit type connector terminal in accordance with the fifth embodiment of the present invention.

The press-fit type connector terminal 500 in accordance with the fifth embodiment, illustrated in FIG. 22, is designed to include a pin section 511 and a shoulder 511 in place of the pin section 111 and the shoulder 112. The pin section 511 and the shoulder 511 are both composed of a metal plate having a thickness greater than the same of a metal plate of which the pin section 111 and the shoulder 112 are composed.

By so designing the section 511 and the shoulder 511, the pin section 511 can have a higher strength, and the press-fit type connector terminal 500 can be inserted into a through-hole with the pin section 511 being horizontally kept.

Sixth Embodiment

Figure 23:
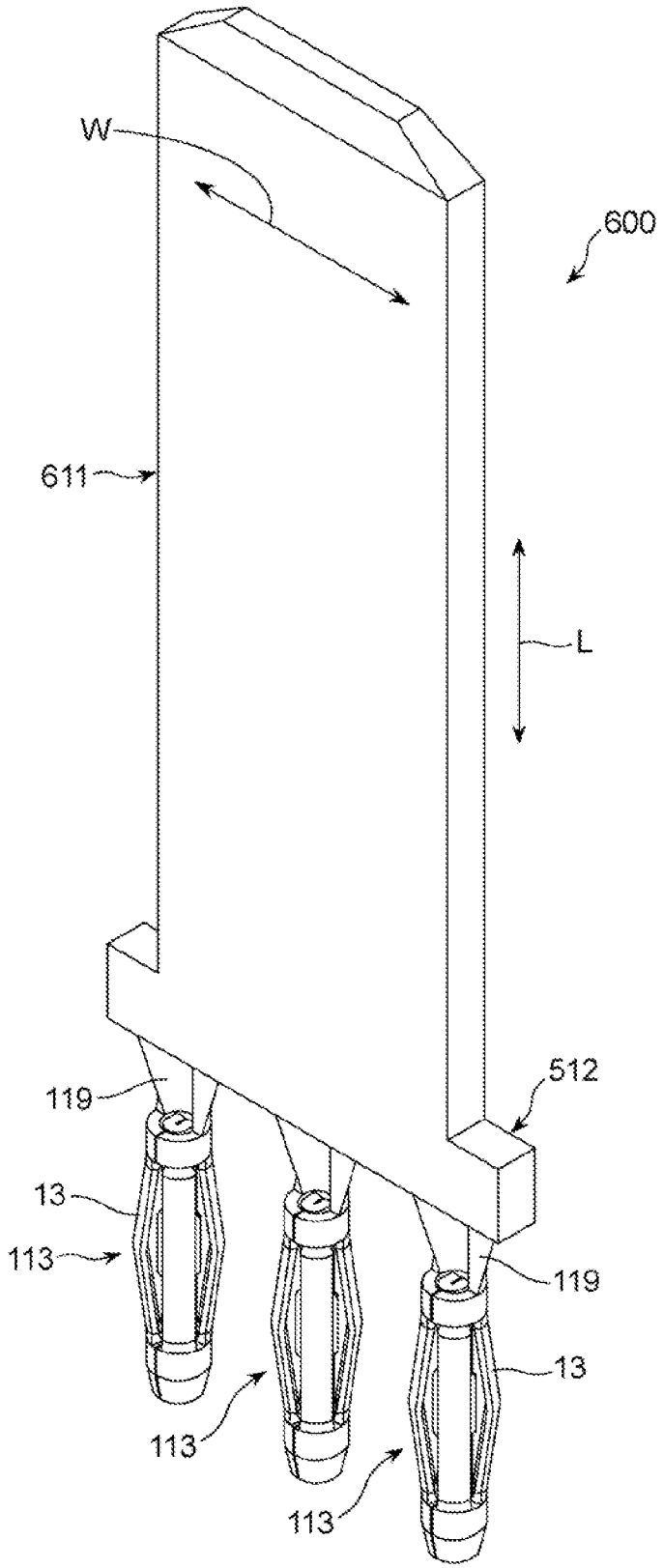
FIG. 23 is a perspective view of the press-fit type connector terminal in accordance with the sixth embodiment of the present invention.

The press-fit type connector terminal 600 in accordance with the sixth embodiment, illustrated in FIG. 23, is designed to include a pin section 611 in the form of a flat plate not folded. A direction in which each of the contact sections 113 is inserted into and pulled out of the through-hole 21 (see FIG. 6) of the printed circuit board 20 is in parallel with a length-wise direction L of the pin section 611. Except a shape of the pin section 611, the press-fit type connector terminal 600 has the same structure and functions as those of the press-fit type connector terminal 500 illustrated in FIG. 22.

By so designing the pin section 611, it is possible to perpendicularly connect the press-fit type connector terminal 600 including the pin section 611 having a high strength, to the printed circuit board 20.

Seventh Embodiment

Figure 24:
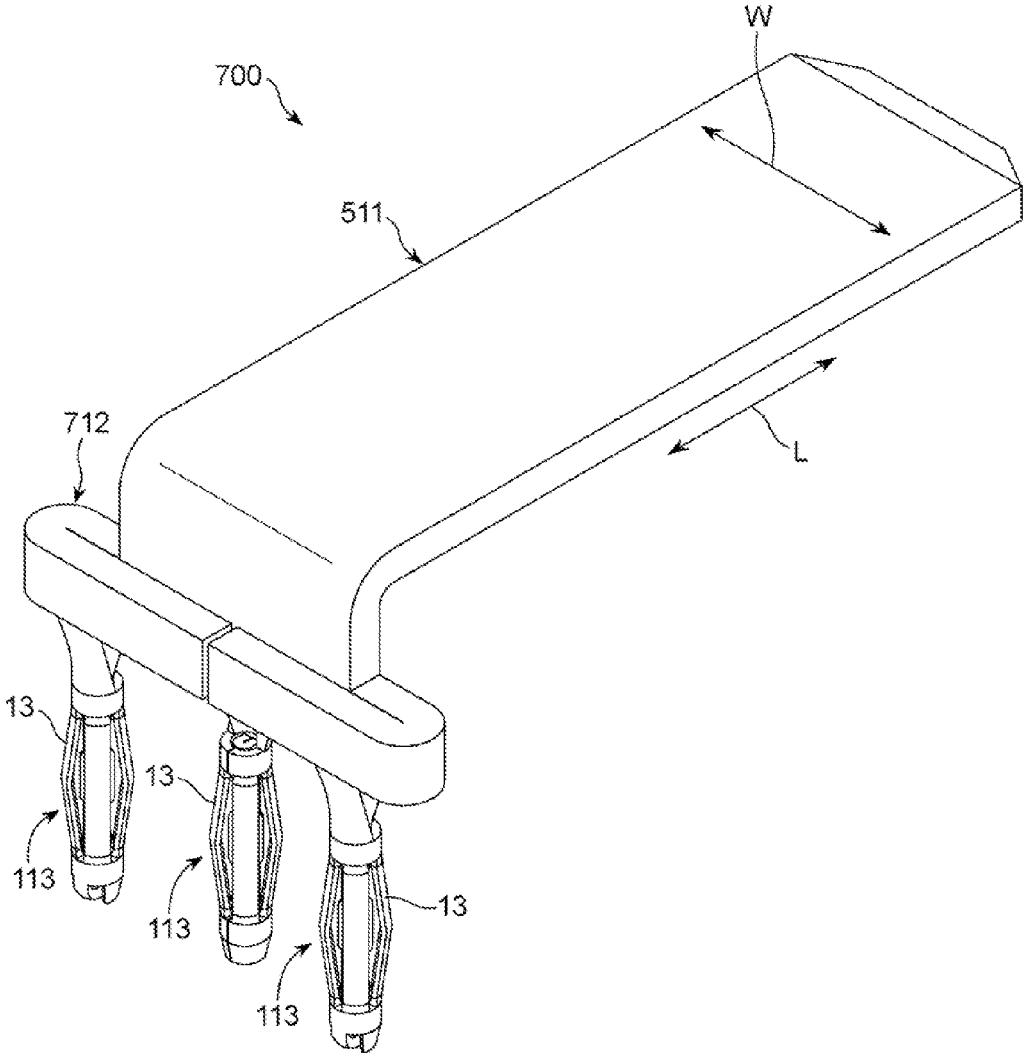
FIG. 24 is a perspective view of the press-fit type connector terminal in accordance with the seventh embodiment of the present invention.

The press-fit type connector terminal 700 in accordance with the seventh embodiment, illustrated in FIG. 24, is designed to include a shoulder 712 having a double-wall structure similarly to the shoulder 312 of the press-fit type connector terminal 300 illustrated in FIG. 13, in place of the shoulder 512 of the press-fit type connector terminal 500 illustrated in FIG. 22, having a single-wall structure.

A metal plate of which the shoulder 712 is formed has a thickness greater than the same of a metal plate of which the shoulder 312 is formed.

By designing the press-fit type connector terminal 700 to include the shoulder 712, since the shoulder 712 has an increased thickness, the press-fit type connector terminal 700 can have an increased strength when inserted into a printed circuit board.

Eighth Embodiment

Figure 25:
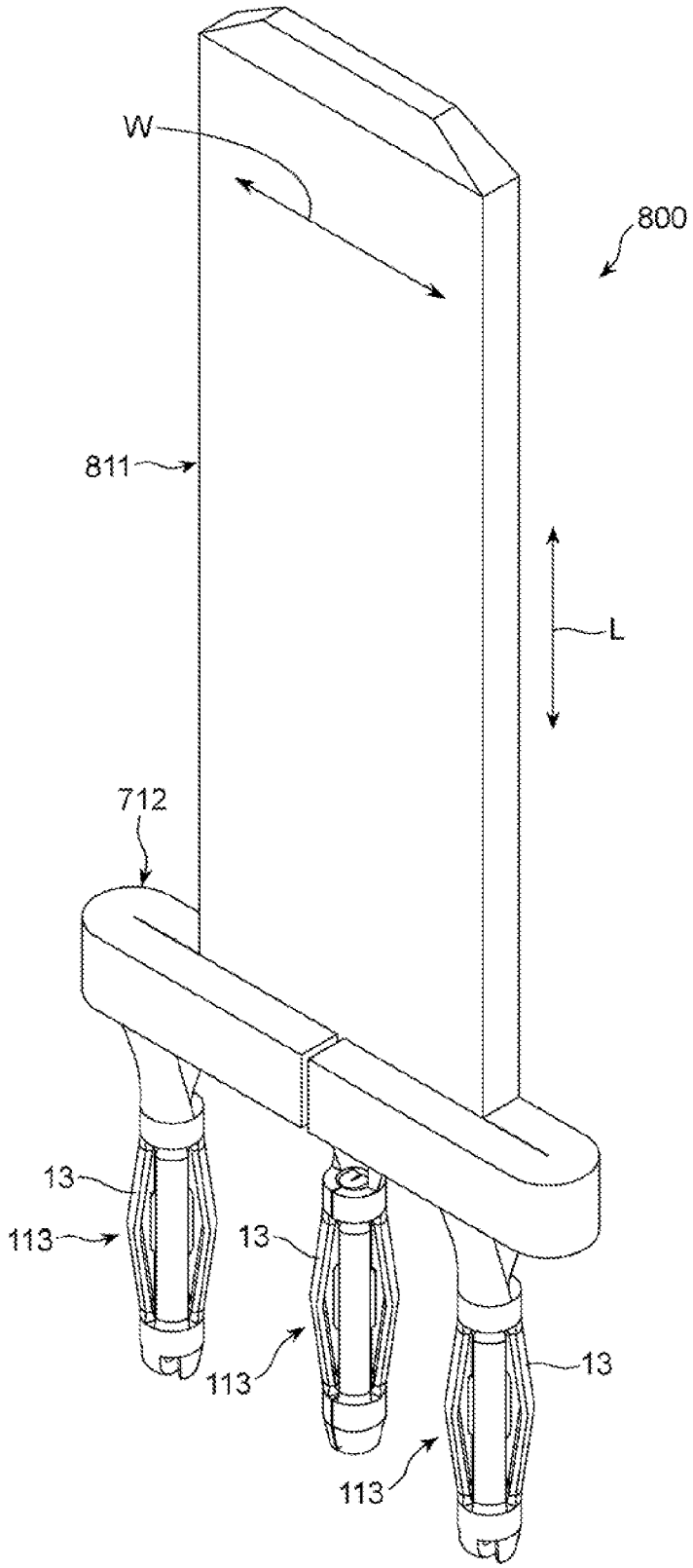
FIG. 25 is a perspective view of the press-fit type connector terminal in accordance with the eighth embodiment of the present invention.

The press-fit type connector terminal 800 in accordance with the eighth embodiment, illustrated in FIG. 25, is designed to include a pin section 811 in the form of a flat plate not folded. A direction in which each of the contact sections 113 is inserted into and pulled out of the through-hole 21 (see FIG. 6) of the printed circuit board 20 is in parallel with a length-wise direction L of the pin section 811. Except a shape of the pin section 811, the press-fit type connector terminal 800 has the same structure and functions as those of the press-fit type connector terminal 700 illustrated in FIG. 24.

By so designing the pin section 811, it is possible to perpendicularly connect the press-fit type connector terminal 800 to the printed circuit board 20, and the shoulder 712 can have an increased strength when the press-fit type connector terminal 800 is inserted into the printed circuit board 20.

Ninth Embodiment

The press-fit type connector terminal 900 in accordance with the ninth embodiment of the present invention is explained hereinbelow with reference to FIGS. 26 to 32B.

The press-fit type connector terminal 900 is formed by bending a single metal plate 910 (see FIGS. 32A and 32B) having elasticity.

The press-fit type connector terminal 900 includes a pin section 911 in the form of a flat plate, and a plurality of contact sections 913 continuous to a front end of the pin section 911.

Each of the contact sections 913 includes a contact piece 93 being in the form of a barrel surrounding an imaginary center line 913*c*. The contact piece 93 is formed at a surface thereof with a slit 94 extending substantially in parallel with the imaginary center line 913*c*. An inner shaft section 114 having a U-shaped cross-section is located in the contact section 913 such that the inner shaft section 114 is continuous with the contact piece 93.

Figure 31:
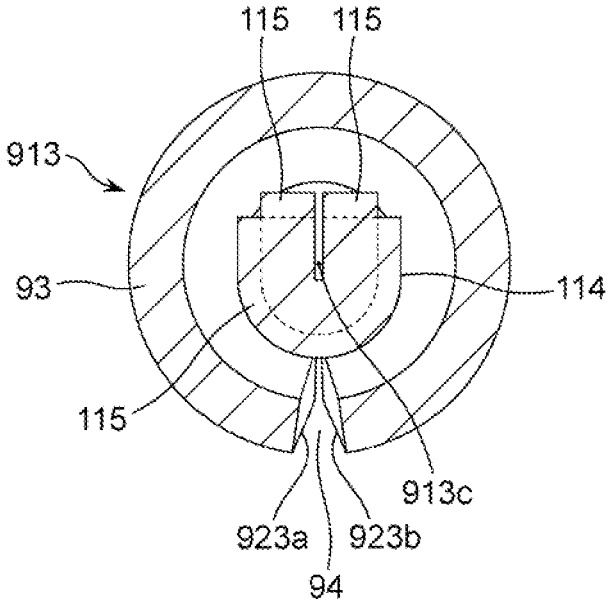
FIG. 31 is a cross-sectional view taken along the line A-A shown in FIG. 28.

Each of the contact pieces 93 is formed at both distal and proximal ends thereof with C-shaped binders 116 and 117 surrounding the inner shaft section 114 which is coaxial with the imaginary center line 913*c*. The binder 116 situated at front ends of the contact pieces 93 has a tapered inclining section 118 at a front end thereof. A shoulder 112 is formed in the vicinity of the contact section 913 in a length-wise direction L of the pin section 911. The shoulder 112 has opposite ends 112*a* located beyond outer surfaces of the pin section 911 and the contact sections 913. As illustrated in FIG. 31, the inner shaft section 114 is designed to include a plurality of protrusions 115 protruding towards the contact piece 93 from an outer surface of the inner shaft section 114.

Figure 26:
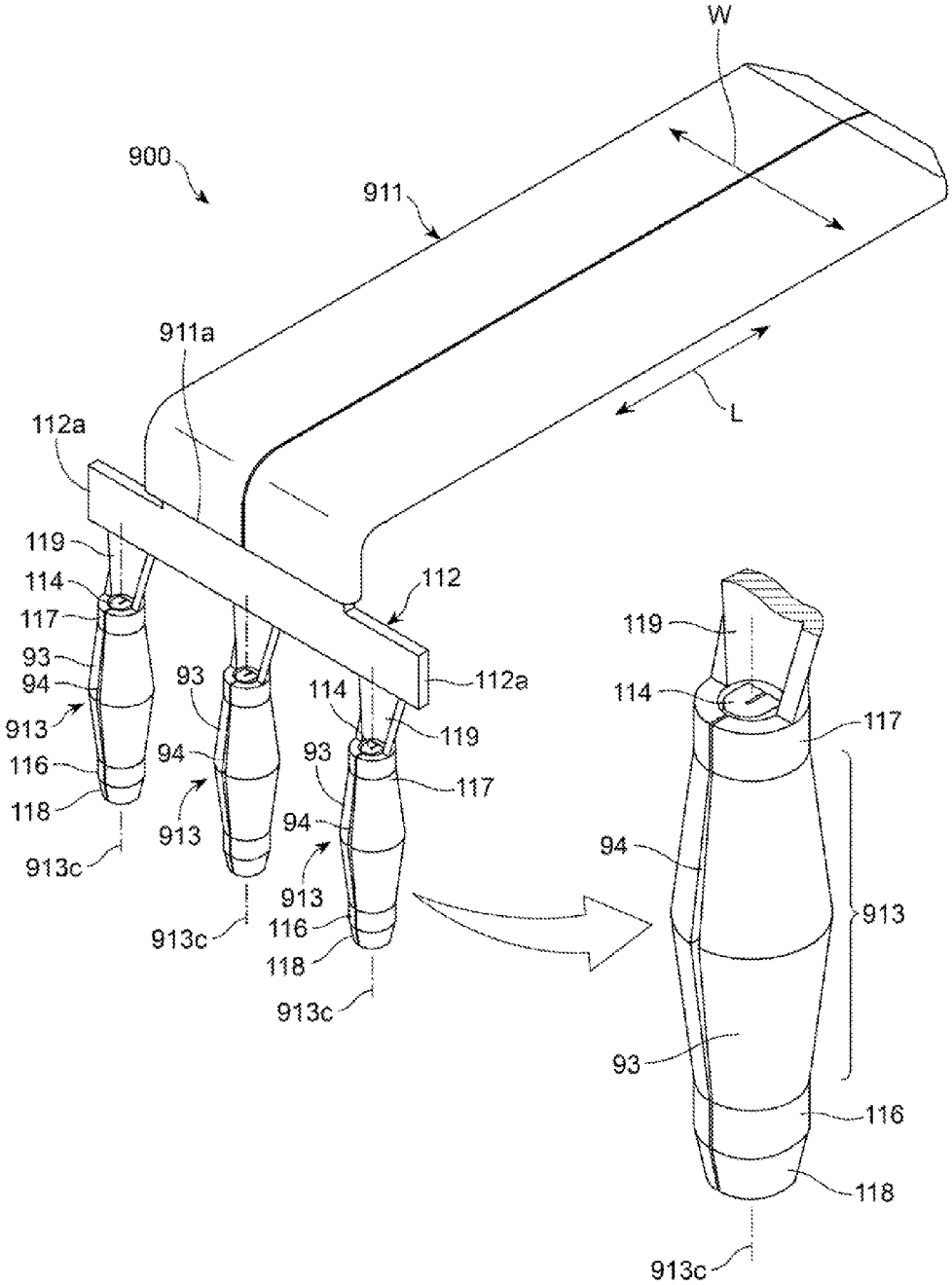
FIG. 26 is a perspective view of the press-fit type connector terminal in accordance with the ninth embodiment of the present invention.
Figure 27:
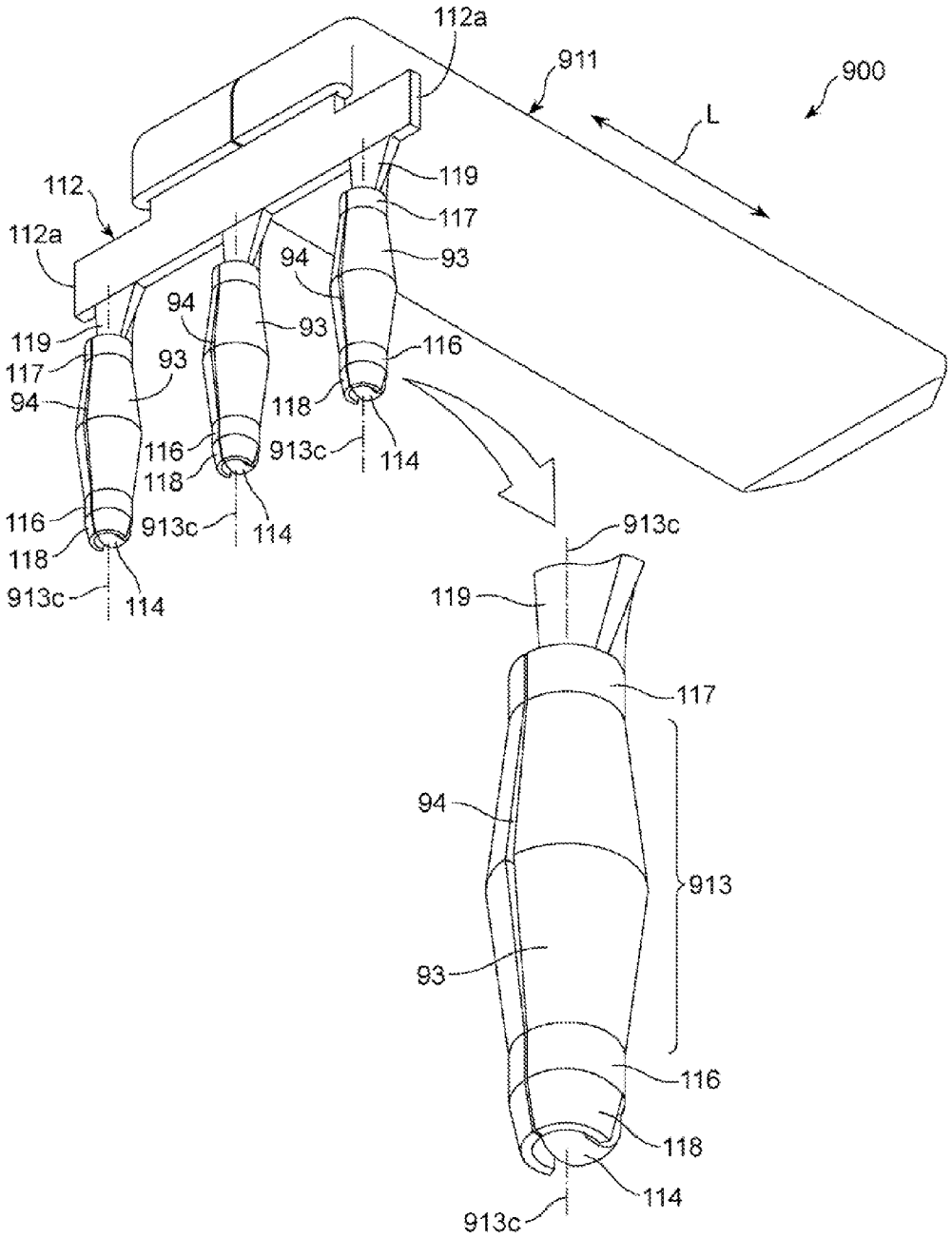
FIG. 27 is a perspective view of the press-fit type connector terminal illustrated in FIG. 26, viewing in a different angle from FIG. 26.
Figure 28:
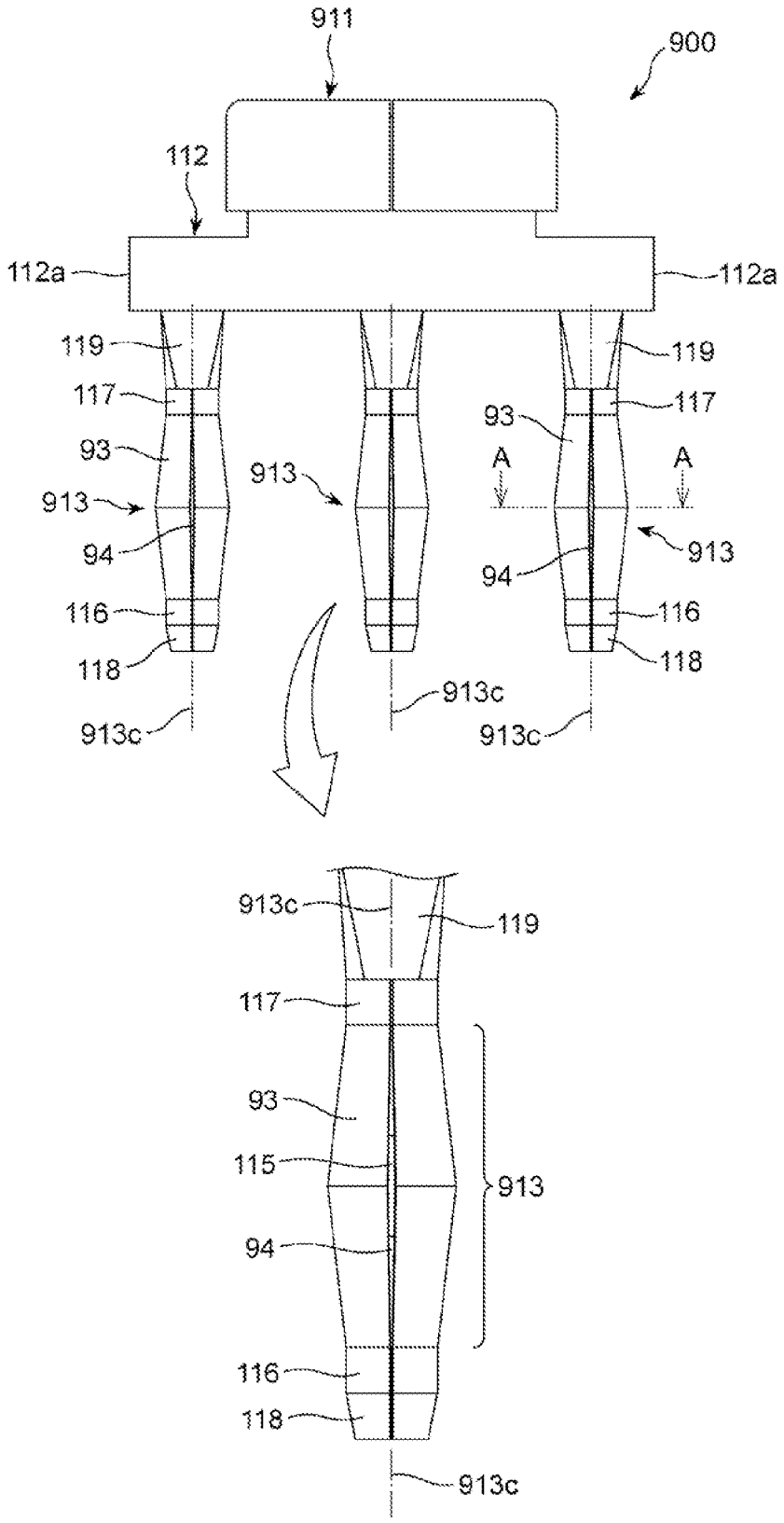
FIG. 28 is a front view of the press-fit type connector terminal illustrated in FIG. 26.
Figure 29:
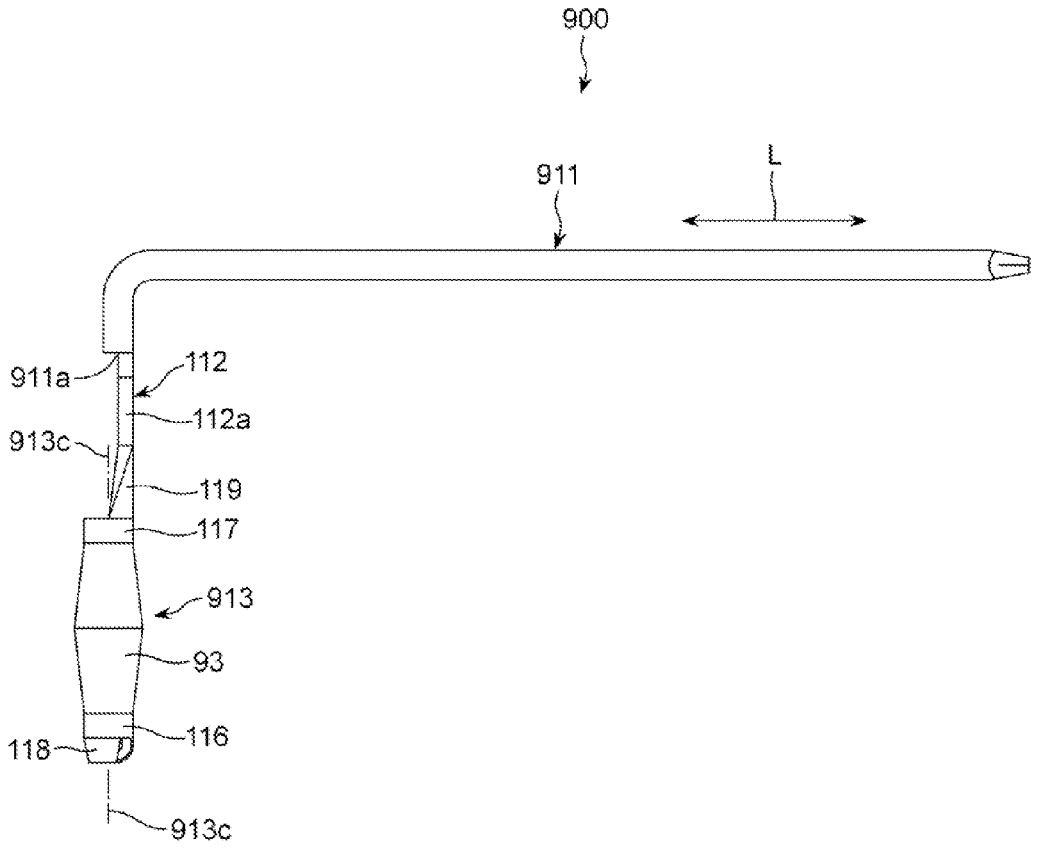
FIG. 29 is a right-side view of the press-fit type connector terminal illustrated in FIG. 26.
Figure 30:
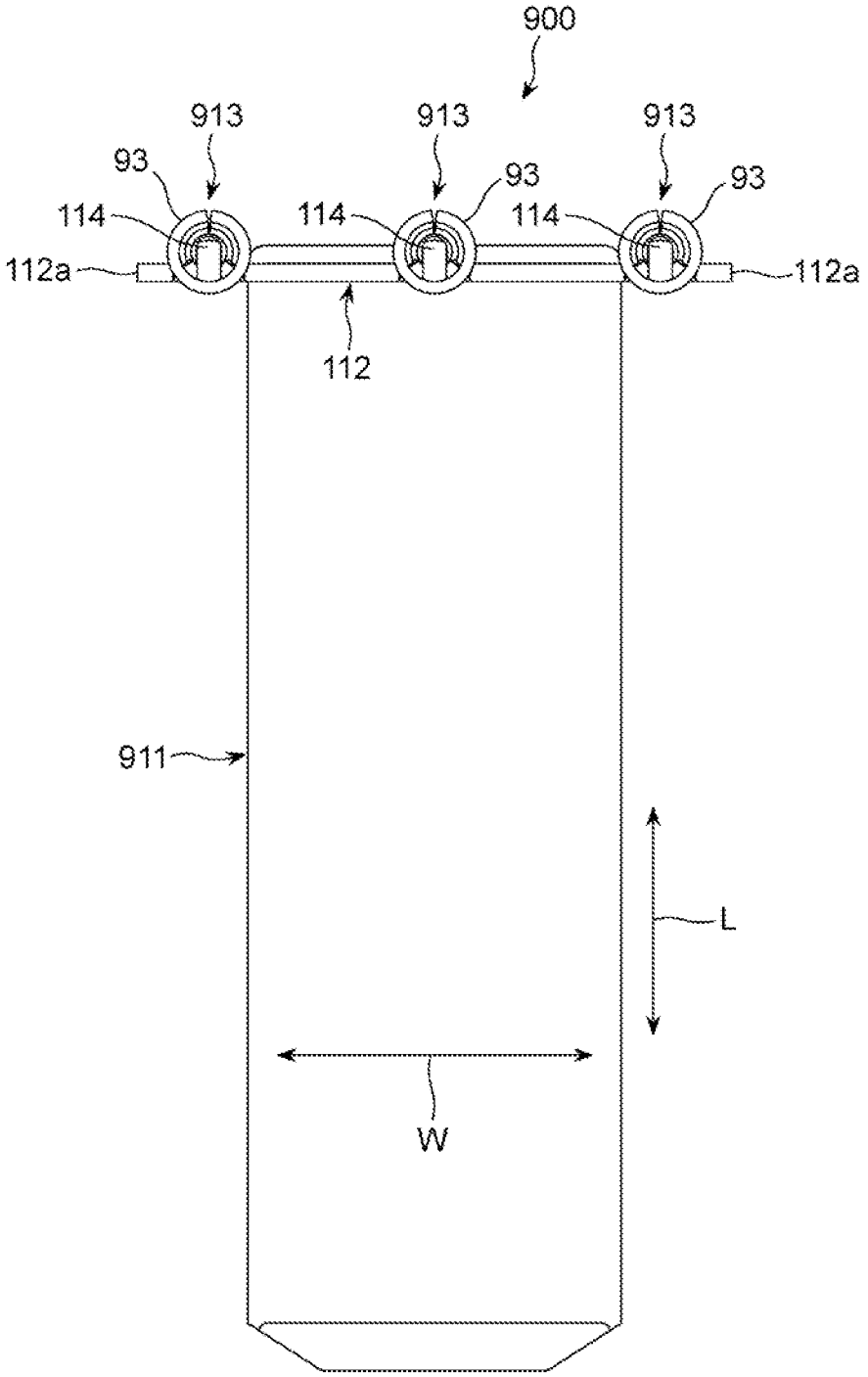
FIG. 30 is a bottom view of the press-fit type connector terminal illustrated in FIG. 26.
Figure 32A:
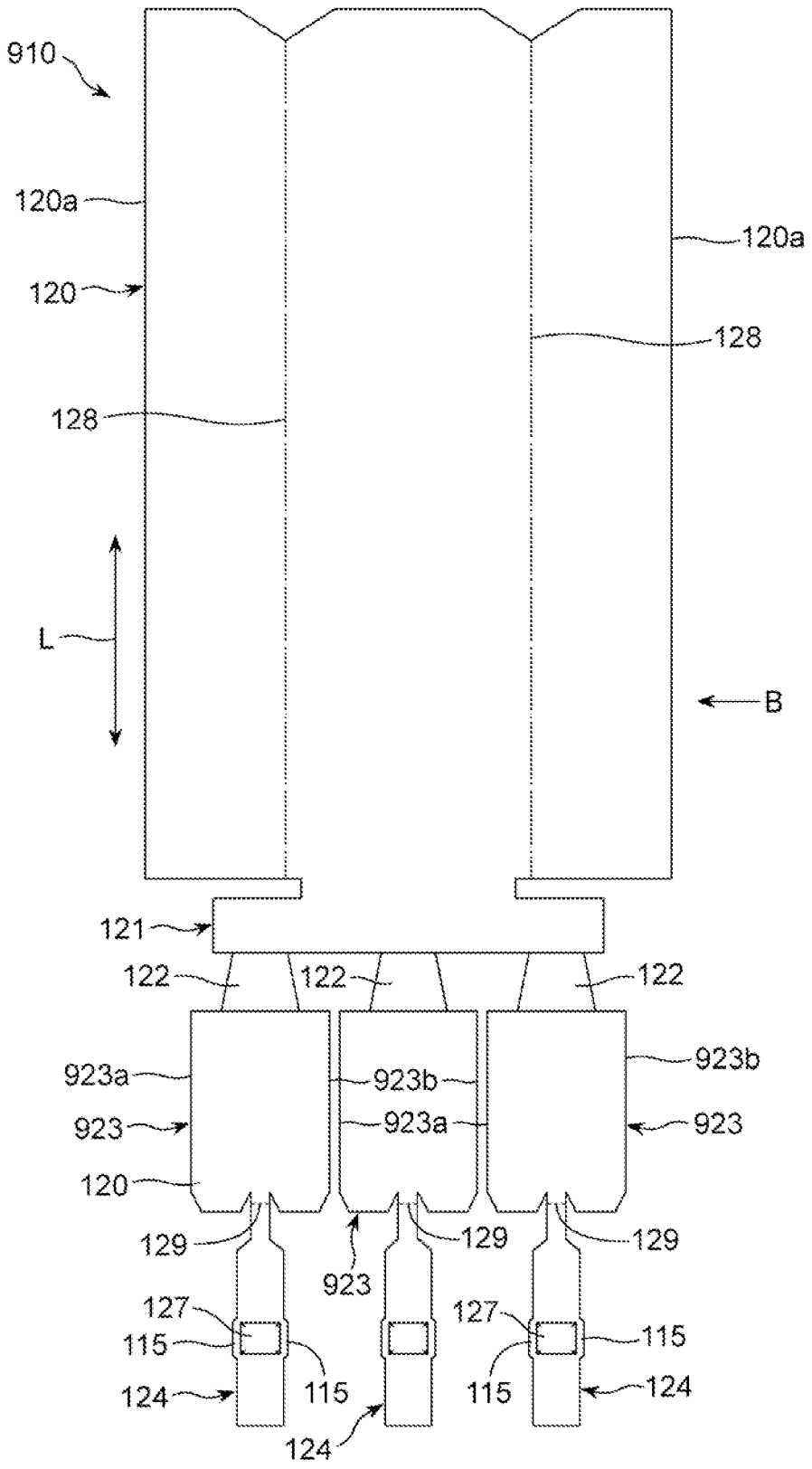
FIG. 32A is a view illustrating a developed metal plate from which the press-fit type connector terminal illustrated in FIG. 26 is fabricated.
Figure 32B:
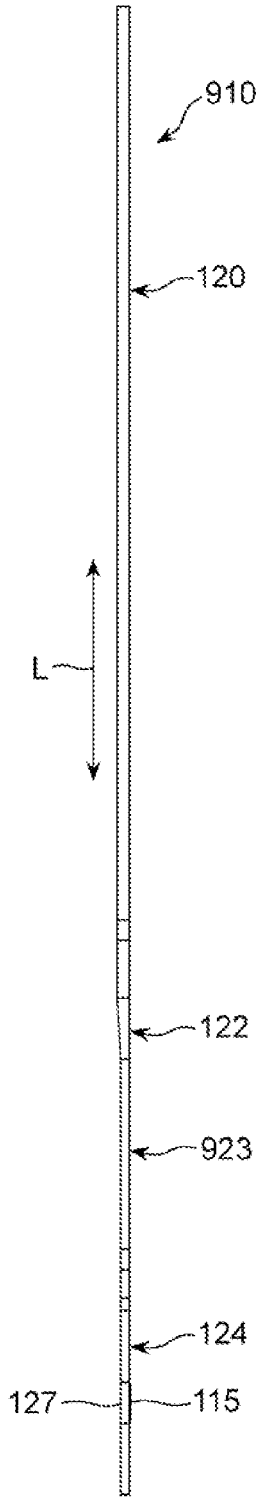
FIG. 32B is a view viewing in a direction indicated with an arrow B shown in FIG. 32A.

The press-fit type connector terminal 900 illustrated in FIG. 26 is made from the metal plate 910 illustrated in FIGS. 32A and 32B. As illustrated in FIGS. 32A and 32B, the metal plate 910 formed by pressing includes a substantially rectangular first area 120 for forming the pin section 911, a substantially rectangular fourth area 121 for forming the shoulder 112, continuous to a front end of the first area 120, a plurality of sixth areas 122 each for forming the tapered connector 119, each continuous to a front end of the fourth area 121, a plurality of second areas 923 each for forming the contact section 913, each continuous to a front end of each of the sixth areas 122, and a plurality of third areas 124 each for forming the inner shaft section 114, each continuous to a front end of each of the second areas 923.

Each of the second areas 923 is in the form of a rectangular flat plate. Each of the third areas 124 is band-shaped and has a width smaller than the same of the second area 923. The third area 124 is centrally formed with a fifth area 127 for forming the protrusion 115. The fifth area 127 protrudes beyond the third area 124 in both width-wise and thickness-wise directions of the third area 124.

The press-fit type connector terminal 900 illustrated in FIG. 26 is formed by bending the metal plate 910 illustrated in FIGS. 32A and 32B as follows.

First, the opposite ends 120*a* of the first area 120 are folded by 180 degrees towards a center of the first area 120 around two fold lines 128 extending in a length-wise direction L of the first area 120. Thus, the pin section 911 (see FIG. 26) is formed.

Then, each of the third areas 124 is folded along a length-wise direction thereof such that each of the third areas 124 has a U-shaped cross-section, to thereby form the inner shaft section 114 (see FIG. 26). Then, the inner shaft section 114 is folded by 180 degrees towards the second area 923 along a fold line 129 extending between the third area 124 and the second area 923. By folding the third area 124 to have a U-shaped cross-section, the protrusion 115 (see FIG. 31) is formed by the fifth area 127.

Then, each of the second areas 923 is folded in the form of a barrel such that each of the second areas 923 surrounds the inner shaft section 114 (or the imaginary center line 913) and the slit 94 (see FIG. 31) faces the side edges 923*a* and 923*b* of each of the second areas 923. Then, the first area 120 is perpendicularly folded in the vicinity of the front end 911*a* thereof in a length-wise direction L thereof to thereby form the pin section 911. Thus, the press-fit type connector terminal 900 illustrated in FIG. 26 is fabricated.

The press-fit type connector terminal 900 is used in the same way and has the same functions as the press-fit type connector terminals 100, 300, 500 and 700 illustrated in FIGS. 1, 13, 22 and 24, respectively, but is structurally different from the press-fit type connector terminals 100, 300, 500 and 700 in that the contact section 913 of the press-fit type connector terminal 900 includes the contact piece 93 having a non-cut continuous shape without the slit 94. By including the contact piece 93, the press-fit type connector terminal 900 makes it possible to increase an area in which the press-fit type connector terminal 900 makes contact with a through-hole of a printed circuit board, and enhance contact reliability.

A shape of the contact piece 913 is not to be limited to a barrel. The contact piece 913 may be designed to be in the form of a spindle outwardly protruding arcuately at about a center in a direction in which the imaginary center line 913*c* extends.

The press-fit type connector terminal 900 is designed to include the three contact sections 913. However, the number of the contact sections 913 is not to be limited to three. The press-fit type connector terminal 900 may be designed to include any number of the contact sections 913 in dependence on a use and conditions in accordance with which the press-fit type connector terminal 900 is employed.

The press-fit type connector terminal 900 is designed to include the inner shaft section 114 in the contact section 913. In contrast, the press-fit type connector terminal 900 may be designed not to include the inner shaft section 114, in which case, the contact section 913 is empty.

The above-mentioned press-fit type connector terminals 100, 200, 300, 400, 500, 600, 700, 800 and 900 are just examples of the present invention. The scope of the present invention is not to be limited to those examples.

INDUSTRIAL APPLICABILITY

The press-fit type connector terminal in accordance with the present invention can be broadly employed, for instance, in fields of electric/electronic industry and automobile industry as a connector to be inserted into a through-hole formed through a printed circuit board for accomplishing electric connection.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2012-61040 filed on Mar. 16, 2012 including specification, claims, drawings and summary is incorporated herein by reference in its entirety.

What is claimed is:

1. A press-fit type connector terminal comprising:

a pin section in the form of a flat plate;

a plurality of contact sections situated continuous to a front end of said pin section; and an inner shaft section in each of said contact sections;

wherein each of said contact sections includes a contact piece in the form of a barrel or a spindle surrounding an imaginary center line, said contact piece being formed with a slit extending substantially parallel to said imaginary center line, wherein said inner shaft section in each of said contact sections is continuous with at least one of said pin section and said contact piece of a respective one of said contact sections, and wherein said connector terminal is comprised of a single bent metal plate having elasticity.

2. A press-fit type connector terminal comprising:

a pin section in the form of a flat plate;

a plurality of contact sections situated continuous to a front end of said pin section; and an inner shaft section in each of said contact sections;

wherein each of said contact sections includes a plurality of "<"-shaped or arcuate contact pieces extending around an imaginary center line and outwardly protruding so as to surround said imaginary center line, wherein said inner shaft section in each of said contact sections is continuous with at least one of said pin section and a respective one of said contact pieces of a respective one of said contact sections, and wherein said connector terminal is comprised of a single bent metal plate having elasticity.

3. The press-fit type connector terminal as set forth in claim 2, wherein said contact pieces are equally spaced away from adjacent ones.

4. The press-fit type connector terminal as set forth in claim 1, wherein said inner shaft section is formed at an outer surface thereof with a protrusion protruding towards a respective contact piece of said contact sections.

5. The press-fit type connector terminal as set forth in claim 2, wherein said inner shaft section is formed at an outer surface thereof with a protrusion protruding towards said contact pieces.

6. The press-fit type connector terminal as set forth in claim 2, further comprising C-shaped binders arranged around distal and proximal ends of each of said contact pieces so as to surround said imaginary center line.

7. The press-fit type connector terminal as set forth in claim 6, further comprising a tapered inclining section at a distal end of said binder situated at a distal end of each of said contact pieces.

8. The press-fit type connector terminal as set forth in claim 1, further comprising a shoulder having a portion protruding beyond an outer surface of said contact sections, said shoulder being situated between said pin section and said contact sections.

9. The press-fit type connector terminal as set forth in claim 2, further comprising a shoulder having a portion protruding beyond an outer surface of said contact sections, said shoulder being situated between said pin section and said contact sections.

10. The press-fit type connector terminal as set forth in claim 1, wherein said metal plate includes:

a first area for forming said pin section, said first area being in the form of a flat plate;

a second area for forming said contact sections, said second area being continuous to a front end of said first area; and a third area for forming said inner shaft section in each of said contact sections, said third area being continuous to a front end of said second area, said second area being substantially rectangular, having a width smaller than a width of said first area, and including a plurality of slits extending in parallel with a longitudinal axis of said first area, said third area being band-shaped and having a width smaller than the width of said second area.

11. The press-fit type connector terminal as set forth in claim 1, wherein said metal plate includes:

a first area for forming said pin section, said first area being in the form of a flat plate; and a second area for forming said contact sections, said second area being continuous to a front end of said first area, said second area being substantially rectangular, and having a width smaller than a width of said first area.

12. The press-fit type connector terminal as set forth in claim 8, said metal plate includes:

a first area for forming said pin section, said first area being in the form of a flat plate;

a second area for forming said contact sections, said second area being continuous to a front end of said first area;

a third area for forming said inner shaft section in each of said contact sections, said third area being continuous to a front end of said second area; and a fourth area for forming said shoulder, said fourth area being located between said first area and said second area, said second area being substantially rectangular, having a width smaller than a width of said first area, and including a plurality of slits extending in parallel with a longitudinal axis of said first area, said third area being band-shaped and having a width smaller than the width of said second area.

13. The press-fit type connector terminal as set forth in claim 9, said metal plate includes:

a first area for forming said pin section, said first area being in the form of a flat plate;

a second area for forming said contact sections, said second area being continuous to a front end of said first area;

a third area for forming said inner shaft section in each of said contact sections, said third area being continuous to a front end of said second area; and a fourth area for forming said shoulder, said fourth area being located between said first area and said second area, said second area being substantially rectangular, having a width smaller than a width of said first area, and including a plurality of slits extending in parallel with a longitudinal axis of said first area, said third area being band-shaped and having a width smaller than the width of said second area.

14. The press-fit type connector terminal as set forth in claim 11, wherein said metal plate further includes a band-shaped third area for forming an inner shaft section, said third area having a width smaller than the width of said second area, said third area being situated continuous to a front end of said second area or between said first area and said second area.

15. The press-fit type connector terminal as set forth in claim 14, wherein said third area includes a fifth area for forming a protrusion, said fifth area protruding beyond said third area in both width-wise and thickness-wise directions of said third area, said protrusion being formed at an outer surface of said inner shaft section and protruding towards said contact piece.

* * * * *